US012091784B2

(12) United States Patent
Tardy et al.

(10) Patent No.: US 12,091,784 B2
(45) Date of Patent: Sep. 17, 2024

(54) SHEDDING ASSEMBLY FOR A LOOM AND ITS ADJUSTMENT METHOD

(71) Applicant: STAUBLI FAVERGES, Faverges-Seythenex (FR)

(72) Inventors: Bastien Tardy, Argonay (FR); Hervé Grange, Cesarches (FR); Alexandre Medici, La Bathie (FR); Raphael Peuget, Pontcharra (FR); Pedro Bernardo, Saint Jorioz (FR)

(73) Assignee: STAUBLI FAVERGES, Faverges-Seythenex (FR)

( * ) Notice: Subject to any disclaimer, the term of this patent is extended or adjusted under 35 U.S.C. 154(b) by 6 days.

(21) Appl. No.: 18/158,449

(22) Filed: Jan. 23, 2023

(65) Prior Publication Data

US 2023/0235488 A1 Jul. 27, 2023

(30) Foreign Application Priority Data

Jan. 27, 2022 (FR) ..... 2200717

(51) Int. Cl.
*D03C 1/14* (2006.01)
*D03C 9/00* (2006.01)

(52) U.S. Cl.
CPC ..... *D03C 1/144* (2013.01)

(58) Field of Classification Search
CPC .... D03C 1/144; D03C 9/0683; D03C 13/025; D03C 5/00
See application file for complete search history.

(56) References Cited

U.S. PATENT DOCUMENTS 4,518,020 A * 5/1985 Speich ..... D03C 5/00 475/14
5,335,699 A * 8/1994 Beyaert ..... D03C 9/065 139/82
5,568,827 A * 10/1996 Debaes ..... D03D 49/70 139/303

(Continued)

FOREIGN PATENT DOCUMENTS

DE 10 2008 032718 B3 12/2009
EP 3 481 977 B1 1/2021
FR 2734610 A1 11/1996

OTHER PUBLICATIONS

Search Report issued in French Patent Application No. 2200717, dated Aug. 23, 2022.

*Primary Examiner* — Robert H Muromoto, Jr.
(74) *Attorney, Agent, or Firm* — MARSHALL, GERSTEIN & BORUN LLP

(57) ABSTRACT

A shedding assembly with a shedding machine includes an eccentric system which defines an eccentric center distance, a first connecting rod, actuated by the eccentric system to actuate a first lever and defining a connecting rod center distance, and a second connecting rod, making the first lever pivot in conjunction with that of a second lever to actuate a heald frame. To facilitate adjustment, the shedding machine includes an adjustment system, which allows at least one adjustment configuration where one of the center-to-center distances is adjustable, as well as a follower member equipping the second connecting rod. The shedding assembly comprises a flap for moving the second connecting rod by driving the follower member for adjusting the center distance when the adjustment system is in the adjustment configuration.

21 Claims, 24 Drawing Sheets

(56) References Cited

U.S. PATENT DOCUMENTS

| | | | | | |
|---|---|---|---|---|---|
| 5,685,346 | A * | 11/1997 | Froment | D03C 1/144 | 139/57 |
| 6,145,548 | A * | 11/2000 | Fumex | D03C 1/16 | 74/105 |
| 6,293,315 | B1 * | 9/2001 | Froment | D03C 3/20 | 139/55.1 |
| 7,448,415 | B2 * | 11/2008 | Pages | F16D 1/06 | 139/81 |
| 7,748,291 | B2 * | 7/2010 | Pages | D03C 5/02 | 74/567 |
| 11,713,521 | B2 * | 8/2023 | Tardy | D03C 1/005 | 139/55.1 |
| 2007/0293976 | A1 * | 12/2007 | Puget | D03C 3/20 | 700/140 |

* cited by examiner

-4A-

-4B-

-11A-

-11B-

SHEDDING ASSEMBLY FOR A LOOM AND ITS ADJUSTMENT METHOD

FIELD

The present invention relates to a shedding assembly, a loom comprising such a shedding assembly, and a method of adjustment.

BACKGROUND

The invention relates to the technical field of shedding machines of the rod-to-frame actuator type, for a heald frame loom.

It is known to employ a plurality of electrical frame actuators to drive heald frames in vertical oscillations. According to the technology employed, the electric actuators produce either oscillating rotation or continuous rotation. In both cases, each electric actuator drives the corresponding heald frame by means of a pulling mechanism, comprising a crank pin, connecting rods and levers, which transform the rotation produced by the actuator into a reciprocating translation of the heald frame. During the operation of the loom, especially when changing articles, it may be necessary to adjust the amplitude and height of the heald frame stroke. Changing the amplitude means changing the opening angle of the warp shed. Changing the height is equivalent to changing the height of the warp sheet crossing.

FR2734610A1 describes a shedding mechanism, where a heald frame actuating lever is connected to the connecting rod crank pin system by means of an adapter or yoke, the position of which is manually adjustable, along an arm belonging to the lever and which can be fixed by means of a clamping screw. However, adjusting this type of system by hand can be tedious and difficult to achieve accuracy.

EP3481977A1 describes a shedding machine with heald frame actuation mechanisms. Each actuation mechanism comprises two levers, one of which is actuated by a coupling rod, coupled to the lever by means of a clip to allow adjustment. The machine also comprises a locking device with locking elements. Each locking element is assigned to a single actuation mechanism, being movable between a weaving position and a locking position. In the locking position, the movement of the lever of the actuation mechanism concerned is prevented beyond an adjustment position. Thus, in the locking position, the levers are positioned at positions that facilitate access to the clips to allow shedding amplitude adjustment by acting on the clips. However, despite this preliminary step of positioning the levers to shift the clips, manual adjustment of this type of system can be tedious and difficult to achieve accuracy.

DE102008032718B3 describes a shedding mechanism where the eccentricity of an eccentric device is adjustable, by moving an eccentric connecting rod drive disk, relative to a connecting member, which is itself rotated by the actuator. The adjustment is done manually by means of an adjustment rod. A disadvantage of this type of adjustment is that the adjustable parts may be difficult to access, a high number of screwing or unscrewing steps is required for adjustment, and a high level of skill is required to perform the adjustment.

SUMMARY

The invention aims to address the drawbacks of the prior art by providing a new shedding assembly for which adjustment of the reciprocating stroke of the heald frame is facilitated.

The invention has as its object a shedding assembly, which comprises at least one shedding machine, for operating a heald frame of a loom according to a reciprocating translational stroke along a frame axis, said at least one shedding machine comprising: a rotary electric actuator; an actuator controller able to control the rotary electric actuator and an eccentric system. The eccentric system comprises: a base by means of which the eccentric system is rotated by the rotary electric actuator about a main axis perpendicular to the frame axis, and a linkage defining an eccentric axis, the eccentric axis being parallel to the main axis. The said at least one shedding machine comprises a first lever, which is pivotable about a first lever axis to actuate said heald frame, the first lever axis and the main axis being parallel; a second lever, which is pivotable about a second lever axis to actuate said heald frame, the second lever axis and the main axis being parallel; and a first connecting rod. The first connecting rod comprises: a first articulation end, by means of which the first connecting rod is coupled to the linkage, such that the eccentric system and the first connecting rod are pivotable relative to each other about the eccentric axis, the eccentric axis and the main axis being distant by an eccentric center distance, and a second articulation end, by means of which the first connecting rod is coupled to the first lever, so that the first lever and the first connecting rod are pivotable relative to each other about an axis of the connecting rod, which is parallel to the main axis, the connecting rod axis and the eccentric axis being distant by a center distance of the connecting rod. Said at least one shedding machine comprises a second connecting rod, which is coupled to the first lever and the second lever, making the second lever pivot in conjunction with the pivoting of the first lever.

According to the invention, said at least one shedding machine comprises: an adjustment system, which comprises the locking means and which allows at least one adjustment configuration, among: an amplitude adjustment configuration, in which the locking means allows movement of the linkage relative to the base so that the eccentric center distance is adjustable, and a height adjustment configuration, in which the locking means allows movement of the second articulation end relative to the first articulation end so that the connecting rod center distance is adjustable. The adjustment system further allows for a locked configuration, in which the eccentric center distance and the connecting rod center distance are fixed, in that the locking means is configured to make the linkage integral with the base and to make the first articulation end integral with the second articulation end. According to the invention, said at least one shedding machine comprises a follower member, which equips the second link. According to the invention, the shedding assembly comprises a flap, which is configured to move the second connecting rod of said at least one shedding machine by driving the follower member, in order to adjust the eccentric center distance, in the case where the adjustment system is in amplitude adjustment configuration, and to adjust the connecting rod center distance, in the case where the adjustment system is in height adjustment configuration.

One idea behind the invention is to provide that, when the shedding machine is in the adjustment configuration, a change in the adjustment is obtained by a movement of the second connecting rod under the action of the flap, to do this the flap drives the follower member. In particular, in the case where the adjustment system is in the amplitude adjustment configuration, it is advantageously provided that the connecting rod center distance is fixed and that the base is immobilized in rotation, so that a movement of the second connecting rod by the flap results in a modification of the orientation of the base of the eccentric system about the main axis, corresponding to a modification of the eccentric center distance. In particular, in the case where the adjustment system is in a height adjustment configuration, it is advantageously provided that the eccentric center distance is fixed and that the base is immobilized in rotation, so that a movement of the second connecting rod by the flap leads to a modification of the value of the connecting rod center distance. In both cases, it is particularly easy to automate the adjustments of the shedding parameters, by automating the flap.

The invention applies to the case where the machine presents an amplitude adjustment configuration, the case where the machine presents a height adjustment configuration, and the case where the machine presents both an amplitude adjustment configuration and a height adjustment configuration. The invention applies to a shedding machine that comprises a shed height adjustment system, or a shed amplitude adjustment system, or both.

Preferably, a plurality of shedding machines are provided, each for operating a respective heald frame, the flap being configured to move the second connecting rods belonging to the respective shedding machines by driving the follower members provided on said second connecting rods.

Preferably, the second connecting rods of the shedding machines are mounted side by side parallel to the main axis; and the flap extends parallel to the first lever axis from one of the second connecting rods to another of the second connecting rods to drive at least one of the follower members provided on the respective one or the other of the second connecting rods in the adjustment configuration of the adjustment system.

Preferably, the flap is pivotable about a control axis parallel to the main axis, to move the second connecting rod by driving the follower member of the at least one shedding machine.

Preferably, the shedding assembly comprises: a flap actuator, which is configured to actuate the flap pivotally about the control axis; and a flap controller, configured to control the flap actuator.

Preferably, the follower member of the at least one shedding machine comprises: a guide profile, which is convex in a connecting rod plane, perpendicular to the first lever axis, the flap pressing against the guide profile, at different pressure points of the guide profile depending on the orientation of the flap, to drive the follower member; and a foot, by means of which the follower member is integral with the second connecting rod, the foot defining a clearance profile for receiving a distal edge of the flap when the flap presses against the guide profile, the clearance profile being concave in the connecting rod plane and extending between the guide profile and the second connecting rod.

Preferably, the flap is movable between: a working position, adopted in an adjustment configuration, where the flap presses against the follower member along a retaining direction, to retain the second connecting rod by means of the follower member, against forces applied by the heald frame, due to gravity, on the first lever and on the second lever, tending to move the second connecting rod in the opposite direction to the retaining direction; and a release position, adopted in a locked configuration, which is reached by moving the flap in the opposite direction to the retaining direction from the working position.

Preferably, in order for the eccentric center distance to be adjustable when the adjustment system is in the amplitude adjustment configuration, the linkage is moveable in translation relative to the base along a translation axis that is perpendicular to the main axis.

Preferably, the base comprises at least one sliding surface parallel to the translation axis, by means of which the base guides the translation of the linkage along the translation axis while securing the rotation of the linkage, when the adjustment system is in the amplitude adjustment configuration.

Preferably, the base comprises a sliding lug forming two sliding surfaces, which are directed away from each other. Preferably, the linkage comprises a fork forming two sliding arms, which are parallel to the translation axis, and which receive the sliding lug between them, so that each sliding arm slides along one of the two sliding surfaces, respectively. Preferably, the locking means comprises a clamping screw, which: in the locked configuration of the adjustment system, is in a locking position of the sliding arms of the fork on the sliding lug, to secure the linkage with the base, and which, in the amplitude adjustment configuration of the adjustment system, is in a release position of the sliding arms on the lug, to allow the movement in translation of the linkage relative to the base.

Preferably, the locking means comprises a clamping screw and a clamping nut, which are coaxial with the main axis. Preferably, the linkage comprises a flange, which extends perpendicular to the main axis, and which comprises an elongated opening, the elongated opening being elongated along the translation axis and receiving the nut. Preferably, the flange is axially clamped against the base by tightening the clamping nut on the clamping screw, to secure the linkage to the base when the adjustment system is in a locked configuration.

Preferably, the said at least one shedding machine comprises a locking system, which allows for a locking configuration, where the locking system immobilizes the base in a reference orientation about the main axis, and a release configuration, where the locking system allows the base to pivot about the main axis.

Preferably, the first connecting rod comprises a first connecting rod end carrying the first articulation end, and a second connecting rod end, carrying the second articulation end, the first connecting rod end and the second connecting rod end being slidably engaged relative to each other along a sliding axis so that the connecting rod center distance is adjustable.

Preferably, the follower member comprises a follower finger, which is integral with the second connecting rod and projects from the second connecting rod perpendicular to the second connecting rod and to the main axis.

The invention also has as its object a loom, comprising the above-defined shedding assembly, as well as at least one heald frame operated according to the reciprocating translational stroke along the frame axis by said at least one shedding machine.

The invention also has as its object an adjustment method, for adjusting said at least one shedding machine belonging to the shedding assembly as defined above, the adjustment method comprising successively: a step of putting the adjustment system in the adjustment configuration; in the case where the adjustment system is in the amplitude adjustment configuration, a step of adjusting the eccentric center distance, by driving the follower member by means of the flap, moving the second connecting rod, and, in the case where the adjustment system is in the height adjustment configuration, a step of adjusting the connecting rod center distance, by driving the follower member by means of the flap, moving the second connecting rod; and a step of putting the adjustment system in a locked configuration.

Preferably, the adjustment method comprises, prior to the step of putting the adjustment system in the adjustment configuration, a step of moving the flap to the working position.

Preferably, the adjustment method comprises: before the step of moving the flap to the working position, a step of pivoting the base to the reference orientation, then a step of locking the base in the reference orientation, by setting the locking system to the locking configuration; and after the step of setting the adjustment system to the locked configuration, a step of allowing the base to pivot, by setting the locking system to the release configuration.

Preferably, when the base is in the reference orientation, the eccentric system and the first connecting rod are positioned so that the main axis, the eccentric axis, and the connecting rod axis are coplanar and arranged successively in that order.

Preferably, when the base is in the reference orientation, the eccentric system and the first connecting rod are positioned so that the eccentric axis, the main axis, and the connecting rod axis are coplanar and arranged successively in that order.

Preferably, the method comprises a selection step, wherein: the follower member of the shedding machine for which the adjustment configuration step is to be implemented, is moved to a docking position in which the flap is able to drive the follower member, the movement of the follower member to the docking position being obtained by moving the second connecting rod under the action of the rotary electric actuator of this shedding machine; and the follower member of another shedding machine, for which the adjustment system will be in a locked configuration during the adjustment configuration step, is moved to a release position so as not to be driven by the flap, the movement of the follower member to the release position being achieved by moving the second connecting rod under the action of the rotary electric actuator of said other shedding machine.

Preferably, in particular during the selection step, the second connecting rod of said shedding machine, for which the adjustment configuration step is going to be performed, is actuated by the rotary electric actuator of said shedding machine until the main axis, the eccentric axis and the connecting rod axis of said shedding machine are co-planar. Preferably, in particular during the selection step, the second connecting rod of said other shedding machine is actuated by the rotary electric actuator of said other shedding machine until the main axis, the eccentric axis and the connecting rod axis of said other shedding machine are coplanar and arranged in a successive order where the eccentric axis and the connecting rod axis are inverted, relative to the eccentric axis and the connecting rod axis of said shedding machine for which the adjustment configuration step is to be performed.

Preferably, the follower member is put into the docking position by bringing the base into the reference orientation. Preferably, the follower member is moved to the release position by moving the base to the release orientation. Preferably, when the base is in the release orientation, the eccentric system and the first connecting rod are positioned so that the main axis, the eccentric axis, and the connecting rod axis are aligned in the same order as when the base is in the reference orientation, except that the main axis and the eccentric axis are inverted.

Preferably, while the follower member is being driven by the flap, the flap is continuously held pressed against the follower member in the retaining direction, against forces applied by the heald frame tending to move the second connecting rod away from the retaining direction.

Preferably, the adjustment system comprises adjustment stops, among amplitude adjustment stops and height adjustment stops. The amplitude adjustment stops limiting the movement of the linkage to limit the variation of the eccentric center distance between a predetermined minimum eccentric center distance value and a predetermined maximum eccentric center distance value, in case the adjustment system can be put in the amplitude adjustment configuration. The height adjustment stops limit the movement of the second articulation end to limit the variation of the connecting rod center distance between a predetermined minimum connecting rod center distance value and a predetermined maximum connecting rod center distance value, in case the adjustment system can be put into the height adjustment configuration.

Preferably, the adjustment method comprises a locking control step, performed after the step of setting the adjustment system to the locked configuration and before the step of allowing the base to pivot. The locking control step comprises a step of checking that the flap actuator does not rotate under the application of a predetermined torque value; and a step of issuing an alarm indicating a locking failure in case a rotational movement of the flap actuator is detected.

Preferably, the adjustment method comprises a release control step, performed after the step of allowing the base to rotate. The release control step comprises a step of verifying that the rotary electric actuator rotates under the application of a predetermined torque value; and a step of issuing an alarm indicating a release failure in case it is determined that the rotary electric actuator has not rotated.

Preferably, during the step of moving the flap to the working position, the first connecting rod is parallel to the translation axis.

Preferably, the method comprises a step of controlling the motor torque of the flap actuator during the step of moving the flap to the working position.

Preferably, the adjustment method comprises turning off a power supply to the rotary electric actuator during the step of setting the adjustment configuration.

Preferably, the adjustment method comprises a prior control step, performed after the step of setting the adjustment system to the adjustment configuration and before the adjustment step, the prior control step comprising a step of rotating the flap actuator, until the adjustment system reaches an adjustment stop; a step of measuring an angle of rotation described by the flap actuator, the adjustment system having reached the adjustment stop; a step of comparing the measured angle of rotation with a predetermined angle corresponding to the predicted rotation based on the position of the adjustment stop to establish whether the shedding machine is in a nominal situation or in a fault situation, such as a loosening fault or an adjustment fault; and a step of issuing an alarm, in case it has been established that the shedding machine is in the fault situation.

BRIEF DESCRIPTION OF THE DRAWINGS

The invention and other advantages thereof will become clearer from the following description of embodiments in accordance with the invention, given by way of example only and made with reference to the drawings below in which.

DESCRIPTION

Figure 1:
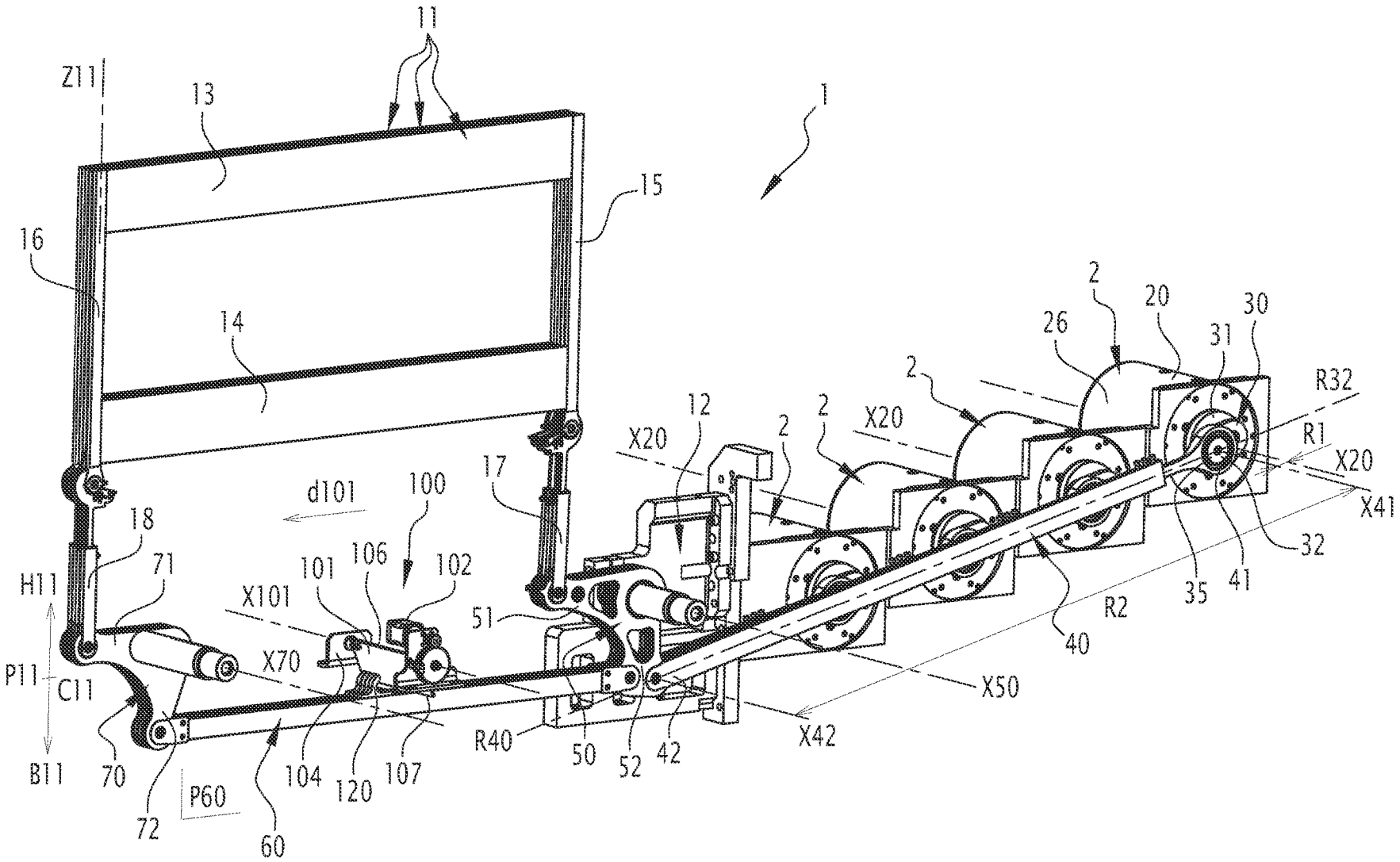
FIG. 1 is a partial perspective view of a loom equipped with a shedding assembly comprising four shedding machines, according to a first embodiment of the invention.

FIG. 1 shows a first embodiment, including a loom 1 with heald frames 11, a frame 12 and the shedding machines 2 for operating the heald frames 11. In FIG. 1, the frames 11 are represented in a reduced scale relative to the machines 2.

Here, four heald frames 11 and four machines 2 are provided, each machine 2 operating one of the frames 11 respectively.

Alternatively, a number of heald frames 11 other than four is provided. Alternatively, a number of machines 2 other than four is provided. Alternatively, it may be provided that a single machine 2 operates several heald frames 11.

Advantageously, each heald frame 11 comprises an upper crossbeam 13, a lower crossbeam 14, parallel to the crossbeam 13 and two uprights 15 and 16, parallel to each other and connecting the cross-beams 13 and 14. Preferably, the crosspieces 13 and 14 are horizontal while the uprights 15 and 16 are vertical. Each heald frame 11 is equipped with a row of healds, not represented, each connecting the crosspieces 13 and 14 and being arranged between the uprights 15 and 16, being distributed along the length of the crosspieces 13 and 14. The healds each carry an eyelet through which a warp thread passes, the warp threads forming a warp thread sheet. The loom 1 advantageously includes other components, such as a sley, weft thread insertion means, which are not represented.

Figure 2:
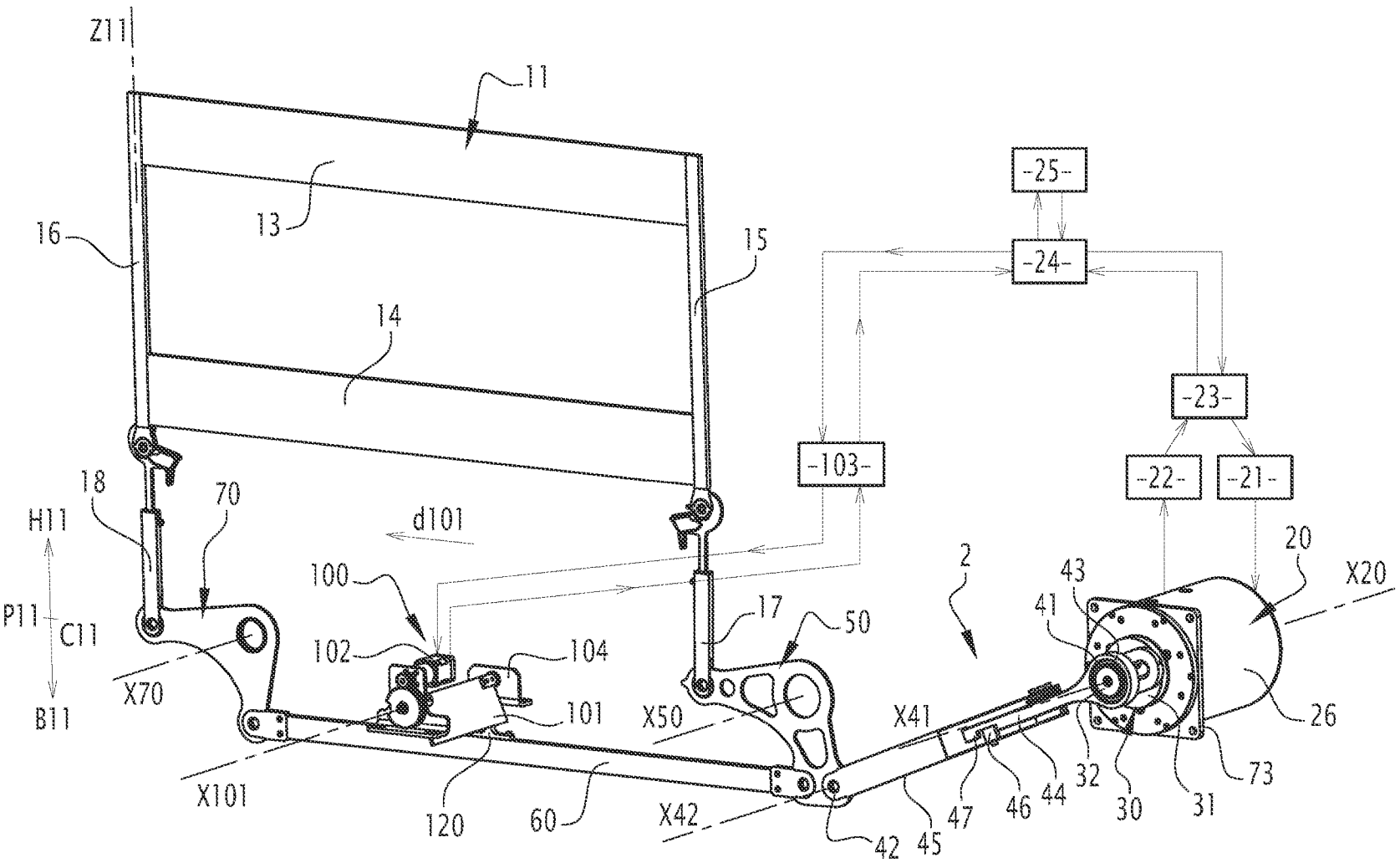
FIG. 2 is a perspective view, from another angle, of a portion of the loom of FIG. 1, where only one of the shedding machines is shown.
Figure 3:
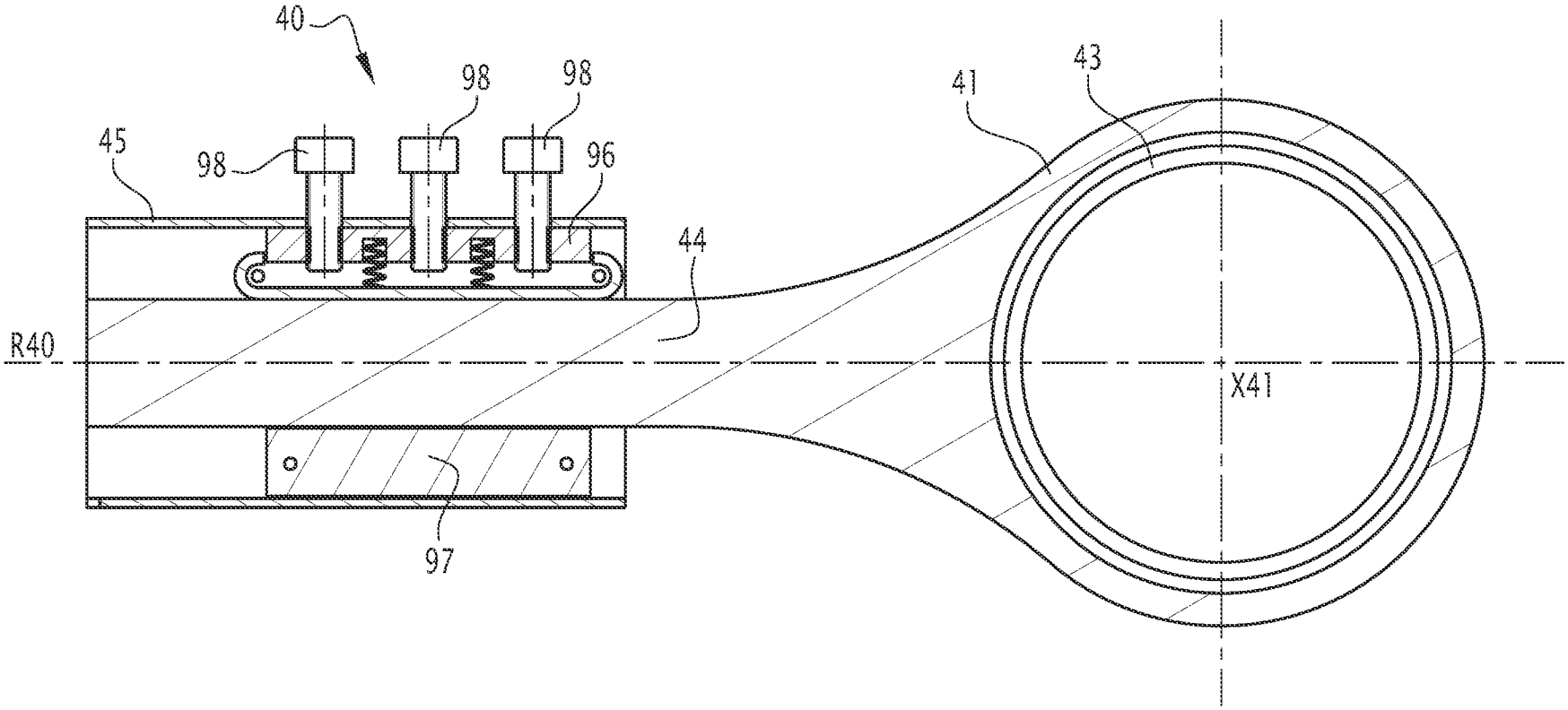
FIG. 3 is a partial longitudinal section of a connecting rod belonging to the shedding machine of the preceding figures.

For the purpose of weaving, each machine 2 is designed to actuate the corresponding heald frame 11 according to a reciprocating translational stroke C11, relative to the frame 12, along a frame axis Z11 specific to this heald frame 11. The term "stroke" refers to the path covered by the heald frame 11 during its movement. FIG. 1 shows the stroke C11 for the heald frame 11 located in the foreground of FIG. 1. Being moved by the machine 2 along the stroke C11, the heald frame 11 is moved parallel to the axis Z11, according to a linear movement, by going back and forth between a high end position H11, corresponding to an upper limit of the stroke C11, and a low end position B11, corresponding to a lower limit of the stroke C11. The axis Z11, and therefore the movement of the heald frame 11, is preferably vertical, or at least parallel to the healds of the frame 11 considered. In FIGS. 1 and 2, the heald frame 11 is shown in the upper end position H11.

During weaving, for the insertion of each weft thread, the position of the heald frames 11 along their respective stroke C11 is determined under the action of the machines 2, independently for each heald frame 11, to define the shed of the loom receiving the inserted weft thread. The loom 1 then produces a fabric of warp and weft threads with a desired weave.

Each shedding machine 2 comprises a rotary electric actuator 20, and a pulling mechanism comprising an eccentric system 30, a connecting rod 40, so-called "transmission rod", a lever 50, a connecting rod 60, a lever 70, a connecting rod 17 and a connecting rod 18.

For each shedding machine 2, the heald frame 11 is actuated by said machine 2 by being actuated by the electric actuator 20 of said machine 2, by the pulling mechanism of said machine 2, connecting the actuator 20 to the heald frame 11.

The actuators 20 are advantageously identical, arranged side by side in the same orientation. As shown in FIG. 1, the actuators 20 are advantageously arranged next to the frames 11, on the lever 50 side. Each rotary electric actuator 20 is an electric motor.

Figure 8:
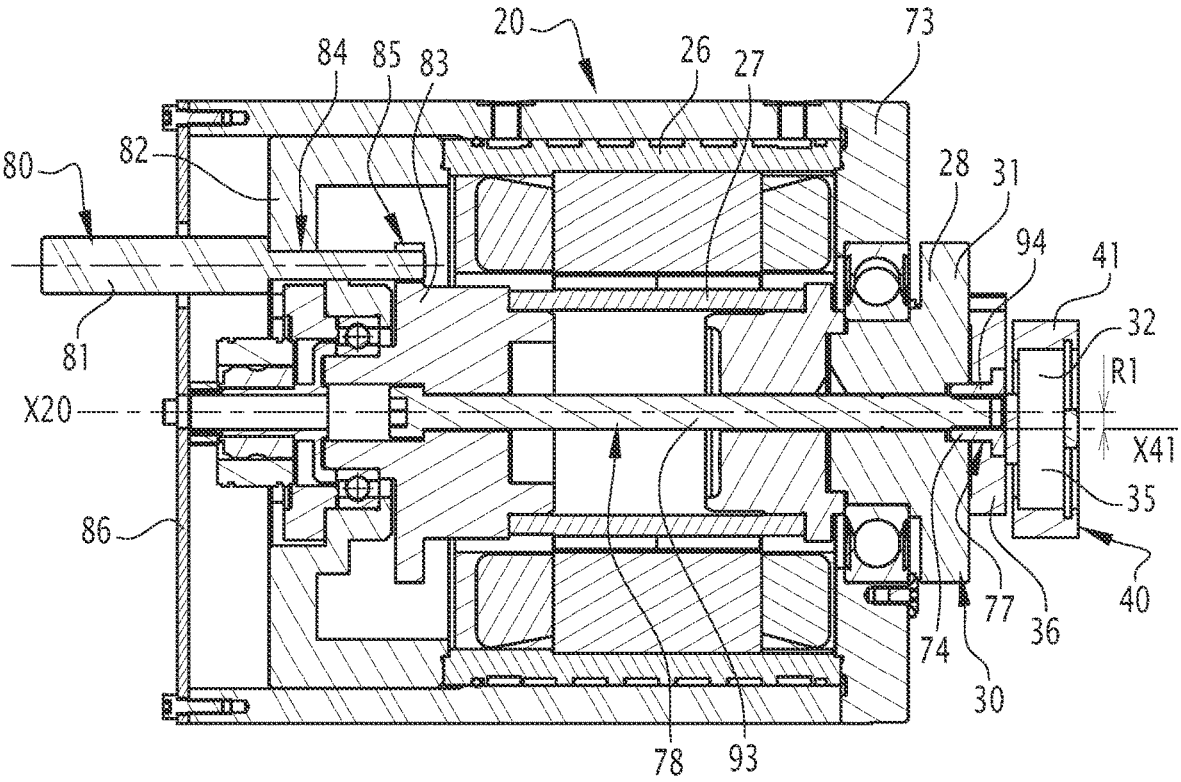
FIG. 8 is a cross-sectional view of the shedding machine of FIGS. 2-7, showing in particular a locking system.

One of the actuators 20 is shown in longitudinal section in FIG. 8. The actuator 20 comprises a stator 26, fixed relative to the frame 12, and a rotor 27 driving an output shaft 28 of the actuator 20.

In the present example, the stator 26 includes a housing, which comprises a circular-based cylindrical wall centered on an axis X20, referred to as the "main axis," and a mounting plate 73 perpendicular to the axis X20, closing a front end of the cylindrical wall and serving to fixedly attach the stator 26 to the frame 12. The rotor 27 is supported by the stator 26 so as to be pivotable about the axis X20 relative to the stator 26. The rotor 27 is coaxial with the axis X20 and is contained within the stator 26. The output shaft 28 is here directly formed at a front end of the rotor 27 and passes through the mounting plate 73 to open to the outside. When the actuator 20 is appropriately supplied electrically by a power circuit 21 belonging to the loom 1, the output shaft 28 is driven in rotation about the axis X20 by the rotor 27. In other words, in order to supply the rotor 27 and/or the stator 26 electrically and control the actuator 20, the actuator 20 is electrically connected to the power circuit 21, as illustrated in FIG. 2.

Alternatively, it may be provided that the rotor and output shaft are separate and non-coaxial elements of the actuator 20, the rotor driving the output shaft by means of a gearbox, with the main axis X20 about which the output shaft rotates being parallel to the axis of rotation of the rotor.

For each actuator 20, the axis X20 is perpendicular to the axis Z11. For each actuator 20, the main axis X20 is advantageously perpendicular to a plane defined by the heald frame 11. The heald frames 11, and the corresponding pulling mechanisms, are distributed parallel to the axis X20 of the actuators 20. Each pulling mechanism is advantageously coplanar with the heald frame 11 that it actuates. The actuators 20 are themselves slightly offset from each other in parallel relative to the axis X20, so that their output shaft 28 is located in the plane of the heald frame 11 and the pulling mechanism it actuates. As the heald frames 11 and the pulling mechanisms are distributed along parallel planes, they do not hinder each other in their movements.

Concerning the actuators 20, other configurations are possible. For example, the actuators 20 can be distributed according to a vertical row, distributed on both sides of the heald frames 11, and/or mounted head to tail, for accessibility or space requirements of the loom 1.

Preferably, during weaving, the actuator 20 performs a continuous rotation, that is, a rotation without changing direction, and not a rotation in oscillation.

As shown in FIG. 1, for each pulling mechanism, the lever 50 is pivotal relative to the frame 12, about an axis X50, called "lever axis", parallel to the main axis X20. The lever 50 is advantageously coplanar with the heald frame 11 to be actuated. The lever 50 is connected to the heald frame 11 to be actuated, by means of the connecting rod 17. For this purpose, the connecting rod 17 is coupled to a radial arm 51, here approximately horizontal, belonging to the lever 50, by an articulation end authorizing a pivoting of the connecting rod 17 relative to the lever 50 about an axis parallel to the axis X50, and is coupled to the heald frame 11, by an articulation end authorizing a pivoting of the connecting rod 17 relative to the heald frame 11 about an axis parallel to the axis X50. The articulation end of the connecting rod 17 with the frame is arranged on the side of the upright 15, at the bottom of the heald frame 11, here at the intersection between the upright 15 and the crossbeam 14. The two articulations of the connecting rod 17 are approximately parallel to the axis Z11. By means of the connecting rod 17, the pivoting in oscillation of the lever 50 actuates and determines the reciprocating translation of the heald frame 11 along the stroke C11.

At any moment, the orientation of the lever 50 relative to the frame 12 corresponds to a single position of the heald frame 11 along the stroke C11. During its pivoting in oscillation, the lever 50 pivots in a first direction to a maximum orientation, where the heald frame 11 is in the high end position H11, and then in a second opposite direction to a minimum orientation, where the heald frame 11 is in the low end position B11. In moving from the maximum orientation to the minimum orientation and back, the lever 50 moves the heald frame 11 through the entire stroke C11.

Likewise, the lever 70 is pivotable relative to the frame 12, about an axis X70, called "lever axis", parallel to the main axis X20. The lever 70 is advantageously coplanar with the heald frame 11 to be actuated. The lever 70 is connected to the heald frame 11 to be actuated, by means of the connecting rod 18. For this purpose, the connecting rod 18 is coupled to a radial arm 71, here approximately horizontal, belonging to the lever 70, by an articulation end allowing a pivoting of the connecting rod 18 relative to the lever 70 about an axis parallel to the axis X70, and is coupled to the heald frame 11, by an articulation end allowing a pivoting of the connecting rod 18 relative t to the heald frame 11 about an axis parallel to the axis X70. The articulation end of the connecting rod 17 with the heald frame 11 is arranged on the side of the upright 16, at the bottom of the heald frame 11, here at the intersection between the upright 16 and the crossbeam 14. The two articulations of the connecting rod 18 are approximately parallel to the axis Z11. The connecting rods 17 and 18 are advantageously parallel. By means of the connecting rod 18, the pivoting in oscillation of the lever 70 actuates and determines the reciprocating translation of the heald frame 11 along the stroke C11.

The levers 50 and 70 are synchronized in their pivoting in oscillation, so as to be in the same orientation relative to the frame 12, about their respective axes X50 and X70. In other words, the connecting rod 60 is coupled to the levers 50 and 70, to subject the pivoting in oscillation of the lever 70 to the pivoting in oscillation of the lever 50. To this end, as shown in FIG. 1, the connecting rod 60 is coupled to a radial arm 52 of the lever 50, here a vertical arm, by an articulation end allowing the connecting rod 60 to pivot relative to the lever 50 about an axis parallel to the axis X50, and to a radial arm 72, here a vertical arm, of the lever 70, by an articulation end allowing the connecting rod to pivot relative to the lever 70 about an axis parallel to the axis X70. The connecting rod 60 is approximately parallel to the crossbeams 13 and 14 of the heald frame 11. The connecting rod 60 is advantageously horizontal, or almost horizontal. The arms 51 and 52 are preferably perpendicular, so that the lever 50 presents a general L shape. The arms 71 and 72 are preferably perpendicular, so that the lever 70 presents a general L shape. An actuation of lever 50 in oscillation about the axis X50 results in a synchronous actuation of lever 70 in oscillation about the axis X70, by means of the connecting rod 60, which results in the actuation of the heald frame 11 in reciprocating translation by both levers 50 and 70 at the same time, by means of the connecting rods 17 and 18.

At any time, the orientation of the lever 50 relative to the frame corresponds to a single position of the connecting rod 60 relative to the frame. At any time, the orientation of the lever 50 relative to the frame corresponds to a single position of the lever 70 relative to the frame.

Figure 4:
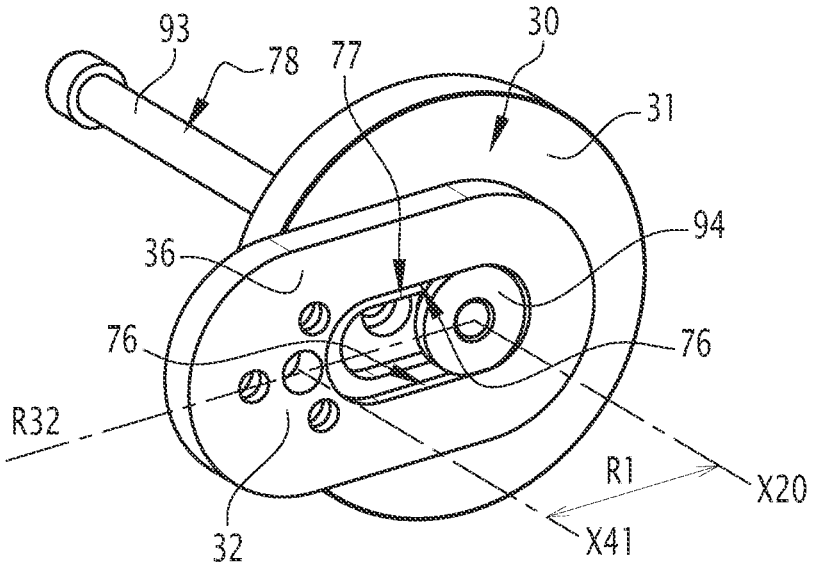
FIG. 4 shows two perspective views of an eccentric system belonging to the shedding machine of the preceding figures, in different configurations.
Figure 4:
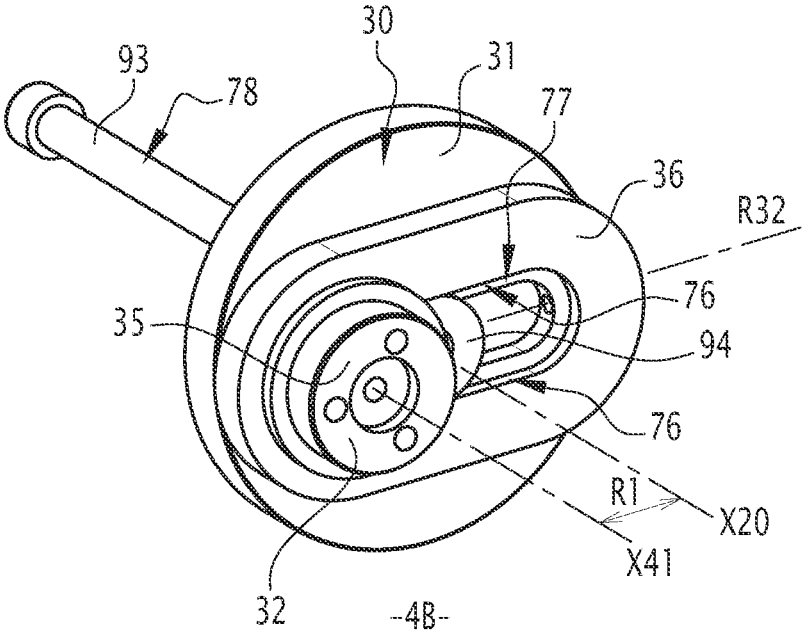
Figure 5:
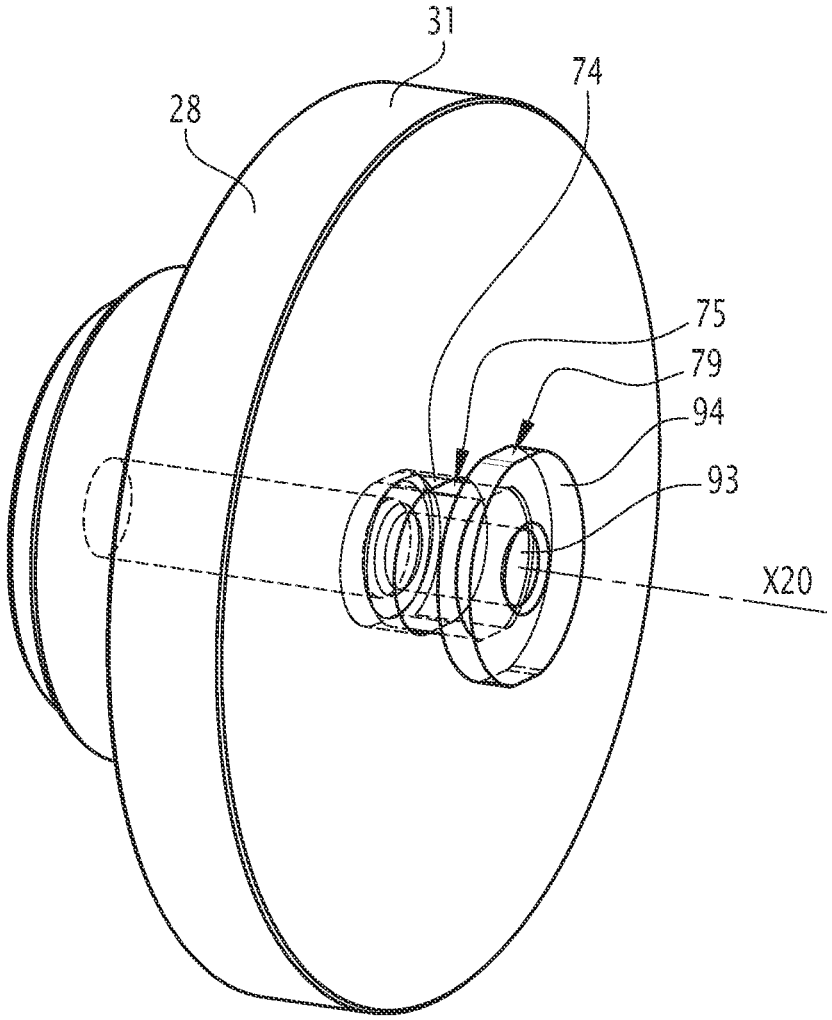
FIG. 5 shows only a portion of the eccentric system of FIG. 4.

The eccentric system can be seen in particular in FIGS. 1 and 2 and is represented in particular in FIGS. 4 and 5. The eccentric system 30 comprises a base 31 and a linkage 32.

Along the axis X20, the base 31 is preferably arranged between the actuator 20 and the linkage 32. The base 31 is directly formed by, or attached to, the output shaft 28 of the actuator 20, so as to be directly driven in rotation about the axis X20 by the actuator 20, relative to the frame 12. The axis X20 is fixed relative to the base 31. The orientation of the output shaft 28 about the axis X20 corresponds to that of the base 31. By means of the base 31, the entire eccentric system 30 is rotated by the actuator 20 about the axis X20. Conversely, the driving in rotation of the eccentric system 30 about the axis X20 drives the rotor around the axis X20.

The lever 50 is driven according to the pivoting in oscillation, that is, with change of direction, by the continuous rotation of the eccentric system 30, that is, without change of direction, by means of the connecting rod 40. The connecting rod 40 converts the continuous rotation of the eccentric system 30 into a pivoting in oscillation of the lever 50. For this purpose, the connecting rod 40 comprises, at a first end, an articulation end 41, and, at a second end, an articulation end 42.

As shown in FIGS. 1 and 2, the connecting rod 40 is coupled to the linkage 32 of the eccentric system 30, by means of the articulation end 41. By means of this articulation end 41, the connecting rod 40 and the linkage 32 are pivotable relative to each other about an axis X41, said "eccentric axis". The axis X41 is fixed relative to the connecting rod 40 and relative to the linkage 32 and is parallel to the axis X20. The axes X41 and X20 are distant from each other by a distance R1, which is a distance measuring the center distance between the axes X41 and X20. This distance R1 is referred to as the "eccentric center distance". As the eccentric system 30 rotates about the axis X20, the axis X41 rotates about the axis X20.

In the present example, the articulation end 41 comprises a circular flange centered on axis X41, and which receives within it a crank pin 35 belonging to the linkage 32, the crank pin 35 being pivotally supported within the flange, by means of a bearing 43, here a roller bearing, centered on axis X41. The crank pin 35 is shown without the circular flange of the connecting rod 40 in view 4B of FIG. 4 and is omitted in view 4A of FIG. 4.

As shown in FIGS. 1 and 2, by means of the articulation end 42, the connecting rod 40 is coupled to the arm 52 of the lever 50. Alternatively, the connecting rod 40 is attached to another arm of the lever 50, which is distinct from the arms 51 and 52. In any case, by means of this articulation end 41, the connecting rod 40 and the lever 50 are pivotable relative to each other about an axis X42, called the "connecting rod axis". The axis X42 is fixed relative to the connecting rod 40 and relative to the lever 50. The axes X42 and X50 are parallel and distant from each other, so that the arm 52 to which the articulation end 42 is connected serves as the lever arm for actuation of the lever 50 by the connecting rod 40. When the connecting rod 40 is driven by the eccentric system 30, the axis X42 rotates about the axis X50. The axis X42 is also parallel to and distant from axis X20. The axes X41 and X42 are parallel and distant from each other by a distance R2, which is a distance measuring the center-to-center distance between the axes X41 and X42. This distance R2 is referred to as the "connecting rod center distance".

In the present example, the articulation end 42 comprises two parallel flanges arranged on either side of the lever 50. These two flanges of the end 42, as well as the arm 52 of the lever 50, are crossed by an opening, coaxially with the axis X42, within which is received a rivet, not represented, to couple the lever 50 and the connecting rod 40 while allowing their relative pivoting.

The pulling mechanisms being distributed side by side along the axis X20, in particular, the connecting rods 60 are distributed side by side along the axis X20. In particular, each connecting rod 60 moves along a connecting rod plane P60 of its own, perpendicular to axis X20, next to the following connecting rod 60. The connecting rod plane P60 is advantageously coplanar with the plane of the heald frame 11, and with a similar connecting rod plane for the connecting rod 40 of the same machine 2.

Each shedding machine 2 comprises an adjustment system, which allows a locked configuration and one or more adjustment configurations. In the locked configuration, the center-to-center distances R1 and R2 are fixed. To perform a weaving operation, it is ensured that the adjustment system is in the locked configuration. In the locked configuration of the adjustment system and in the weaving operation of the loom, the center distances R1 and R2 cannot be changed. For each adjustment configuration, one of the center distances R1 and R2 is variable so that it can be adjusted, whereas the other center distance R1 or R2 is fixed. Here, the adjustment system allows to alternate between the locked configuration, an amplitude adjustment configuration where the eccentric center distance R1 is variable while the connecting rod center distance R2 is fixed, and a height adjustment configuration where the distance R2 is variable while the distance R1 is fixed. Alternatively, it could be provided that the adjustment system only evolves between the locked configuration and only one of the adjustment configurations, for example the height adjustment configuration.

Due to the structure of the pulling mechanism, changing the eccentric center distance R1 correspondingly changes the amplitude of the stroke C11, that is, the distance between the high end position H11 and the low end position B11 taken by the heald frame 11 when it is driven under the action of the actuator 20 while the adjustment system is in the locked configuration. In the present case, the greater the distance R1, the greater the amplitude of the stroke C11, that is, more the distance between positions B11 and H11 is greater. Changing the eccentric center distance R1 therefore allows the amplitude of the shed opening controlled by the heald frame 11 to be changed. For example, it is provided that the distance R1 can be varied from a minimum value of 20 mm (millimeters) to a maximum value of 60 mm, to vary the amplitude of the stroke C11 from a minimum value of 50 mm to a maximum value of 160 mm, when the height of the stroke C11 is centered on a reference position P11, in other words, with the positions B11 and H11 equidistant from the position P11. The reference position P11 is defined as being a central position, which can correspond to the crossing position of the loom 1 for all the yarn sheets.

Due to the structure of the pulling mechanism, changing the connecting rod center distance R2 correspondingly changes the height of the stroke C11 relative to the frame 12, in other words, the height of the stroke C11 relative to the reference position P11 of the heald frame 11 relative to the frame 12 along the axis Z11, shown in FIG. 1. In particular, increasing the connecting rod center distance R2 shifts both the end position H11 and the end position B11 upward relative to the position P11. Conversely, decreasing the connecting rod center distance R2 shifts both the end position H11 and the end position B11 downward relative to position P11. Preferably, changing the distance R2 does not change the amplitude of the stroke C11, in other words, does not change the distance between positions B11 and H11. Changing the connecting rod center distance R2 therefore allows the shed crossing to be changed by adjusting the opening height of the shed controlled by the heald frame 11. For example, it is provided that the distance R2 can be varied from −6 mm to +6 mm relative to a central value, corresponding to a height shift of the stroke C11 from −8 mm to +8 mm relative to the reference position P11.

Figure 10:
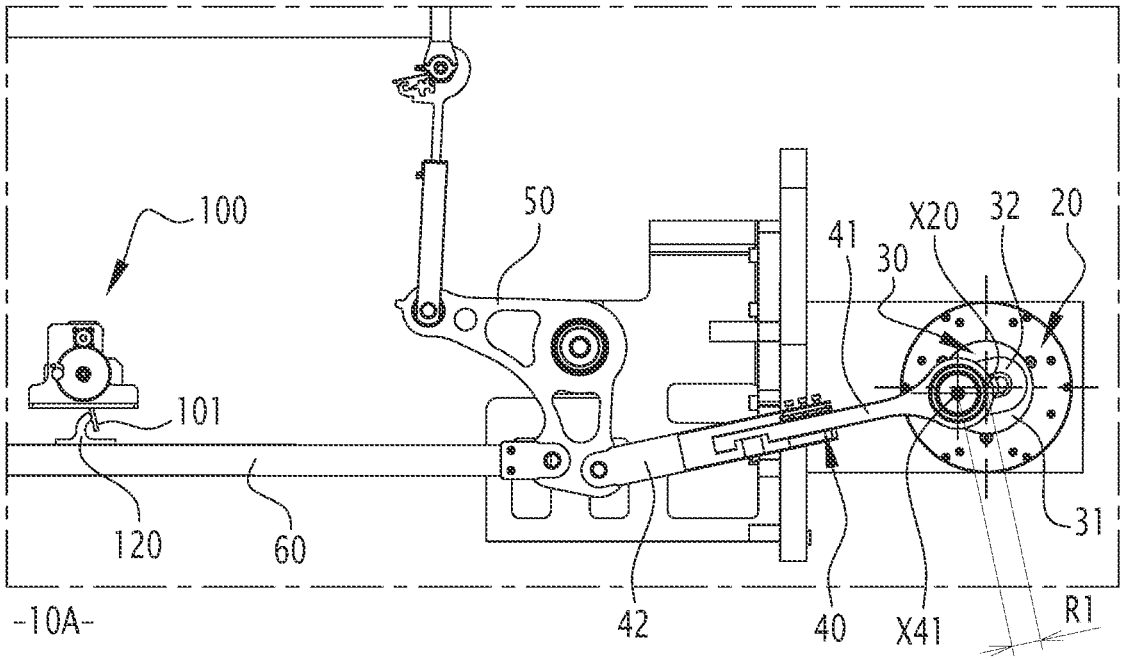
FIG. 10 shows two partial front views 10A and 10B of the same elements as in FIG. 2, in the amplitude adjustment configuration.
Figure 10:
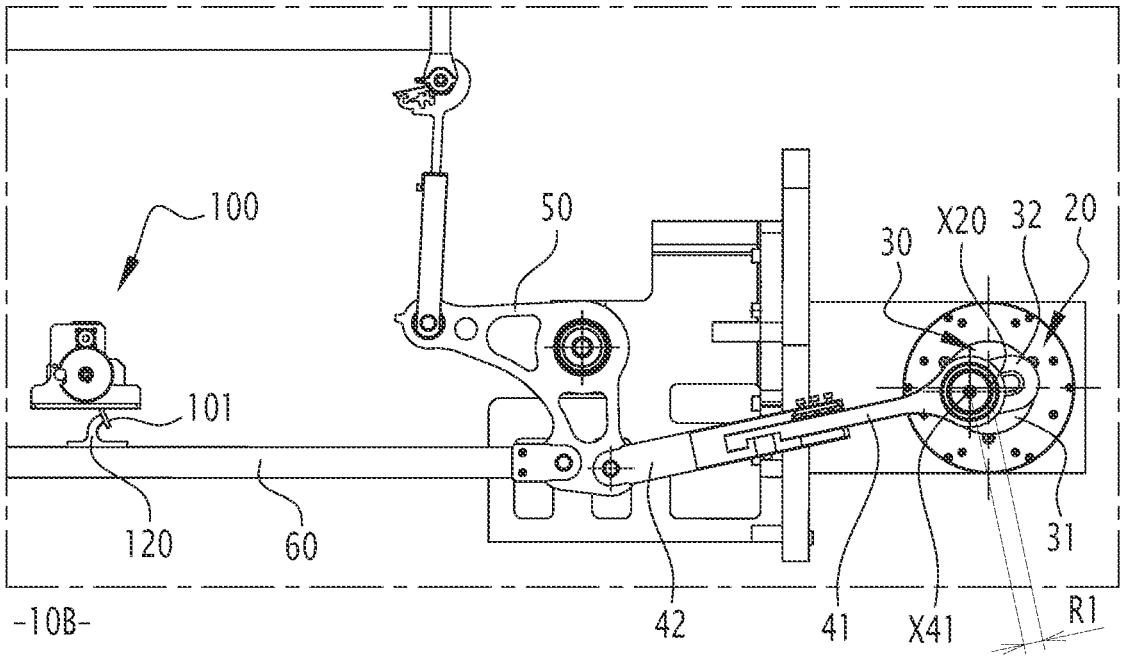

As illustrated in FIGS. 4, 8 and 10, so that the eccentric center distance R1 can be variable, the geometry of the eccentric system 30 is modulable, and in particular the linkage 32 is made movable relative to the base 31. The adjustment system comprises locking means for selectively allowing this movement, to obtain the amplitude adjustment configuration, and prohibiting this movement, to obtain the locked configuration or the height adjustment configuration.

The base 31 here forms a discoidal plate perpendicular to the axis X20, formed at one end of the output shaft 28 and best seen in FIG. 5. For this embodiment, the linkage 32 comprises the crank pin 35, visible in particular for the case 4B in FIG. 4, and a flange 36. In the example, the crank pin 35 is generally cylindrical in shape with a circular base, and is centered on the axis X41, to support the pivoting of the connecting rod 40 relative to the linkage 32.

The flange 36 is integral with the crank pin 35, as can be seen in particular in FIGS. 4 and 8. In the present example, the flange 36 forms a flat part, perpendicular to the axis X20 and crossed by the axes X20 and X41. Along the axis X20, the flange 36 is arranged between the base 31 and the crank pin 35. The crank pin 35 projects from the flange 36 in a direction away from the actuator 20. To achieve the assembly of the crank pin 35 with the flange 36, it is advantageously provided that the crank pin 35 is fixed by screws, or similar fasteners, to the flange 36.

In this example, in order to obtain that the distance R1 is variable when the adjustment system is in amplitude adjustment configuration, the linkage 32 is supported by the base 31 while being moveable in radial translation relative to the base 31, along an axis of translation R32. The linkage 32 is also prevented from pivoting relative to the base 31, about the axis X20. The axis R32 is radial relative to the axis X20, that is, it intersects the axis X20 and is perpendicular to the axis X20. The axis R32 is parallel to the R1 distance. For any position of the linkage 32 relative to the base 31, the axis R32 intersects the axis X20 and the axis X41. By movement in translation of the linkage 32 relative to the base 31 along the axis R32, the distance R1 is varied. Indeed, the axis X41 being fixed relative to the linkage 32 and the axis X20 being fixed relative to the base 31, the relative movement of these two parts makes the distance R1, which separates these axes X20 and X41, vary.

In order to obtain that the linkage 32 is moveable in radial translation relative to the base 31, while being able to be selectively fixed in radial translation relative to the base 31, it is preferentially provided that the flange 36 comprises an oblong opening 77, clearly visible in FIG. 4 and that the eccentric system 30 comprises a rod 78, visible in FIGS. 4 and 8. The oblong opening 77 extends through the flange 36, parallel to the axis X20. The oblong opening 77 is elongated along the translation axis R32 and extends along this axis R32. The rod 78 is coaxial with the axis X20 and extends through the oblong opening 77 to support the flange 36 by means of the oblong hole 77. The rod 78 supports and guides the radial translation of the oblong opening 77 along the axis R32. The rod 78 also prevents pivoting of the oblong opening 77 about the axis X20, relative to the base 31, by forming both flats 75, shown in FIG. 5, which cooperate with the flats of the base 31, and also the sliding surfaces 79, which cooperate with the parallel edges 76 of the oblong opening 77.

Specifically, as shown in FIGS. 4, 5 and 8, the rod 78 preferably comprises a clamping screw 93 and a clamping nut 94, thereby providing the locking means of the adjustment system for selectively fixing and allowing the variation of the distance R1. The nut 94 is also used configured to guide the radial translation of the linkage 32 along the axis R32 and to prevent its rotation about the axis X20.

In detail, the screw 93 and the nut 94 are screwed into each other coaxially with the axis X20. The screw 93 passes through the base 31 along the axis X20 and is pivotal relative to the base 31 about the axis X20 to perform the screwing and unscrewing with the nut 94. As can be seen in FIG. 5, the nut 94 is prevented from rotating relative to the base 31 about the axis X20, while being allowed to move in translation relative to the base 31 along the axis X20. For this purpose, it is provided that a rear end 74 of the nut 94 is received in a central opening of the base 31, centered on the axis X20. The rear end 74 and this central opening have complementary anti-rotation shapes. For example, as shown in FIG. 5, the rear end 74 comprises the flats 75, which are diametrically opposed, cooperating with complementary flats belonging to the central opening of the base 31, to prohibit rotation of the nut 94 about the axis X20 relative to the base 31, while guiding translation of the nut 94 along axis X20 relative to the base 31.

These arrangements ensure that when the screw 93 is pivoted about the axis X20 relative to the base 31, the nut 94 moves in translation along the axis X20, relative to the base 31, without rotation about the axis X20.

Furthermore, the nut 94 is received in the oblong opening 77, so as to serve as a bearing for the radial translation of the flange 36, when the adjustment system is in the amplitude adjustment configuration. Preferably, by screwing the screw 93 with the nut 94, the nut 94 presses axially against a peripheral edge of the oblong opening 77, in the direction of the actuator 20, and a head of the screw 93 presses against the rotor 27, in the opposite direction, in order to immobilize the linkage 32 relative to the base 31 and to the rotor 27, by clamping the flange 36 along the axis X20. In other words, the flange 36 is axially clamped against the base 31 by the clamping nut 94, to secure the linkage 32 to the base 31 when the adjustment system is in the locked configuration.

As shown in FIG. 5, at its forward end, the nut 94 forms the sliding surfaces 79, which present here in the form of two diametrically opposed flats. The sliding surfaces 79 cooperate with two complementary straight edges belonging to the oblong opening 77. Thanks to these surfaces 79, the linkage 32 is guided in translation along the axis R32 relative to the nut 94, while being fixed in rotation about the axis X20 relative to the nut 94. Since the nut 94 is itself rotationally fixed relative to the base 31, it follows that the linkage 32 is rotationally fixed relative to the base 31 about the axis X20, by means of the nut 94.

In summary, to obtain the amplitude adjustment configuration, the screw 93 and the nut 94 are loosened, which allows the movement in translation of the linkage 32 relative to the base 31. To obtain the locked configuration, the screw 93 and the nut 94 are tightened, thus securing the linkage 32 to the base 31.

Figure 9:
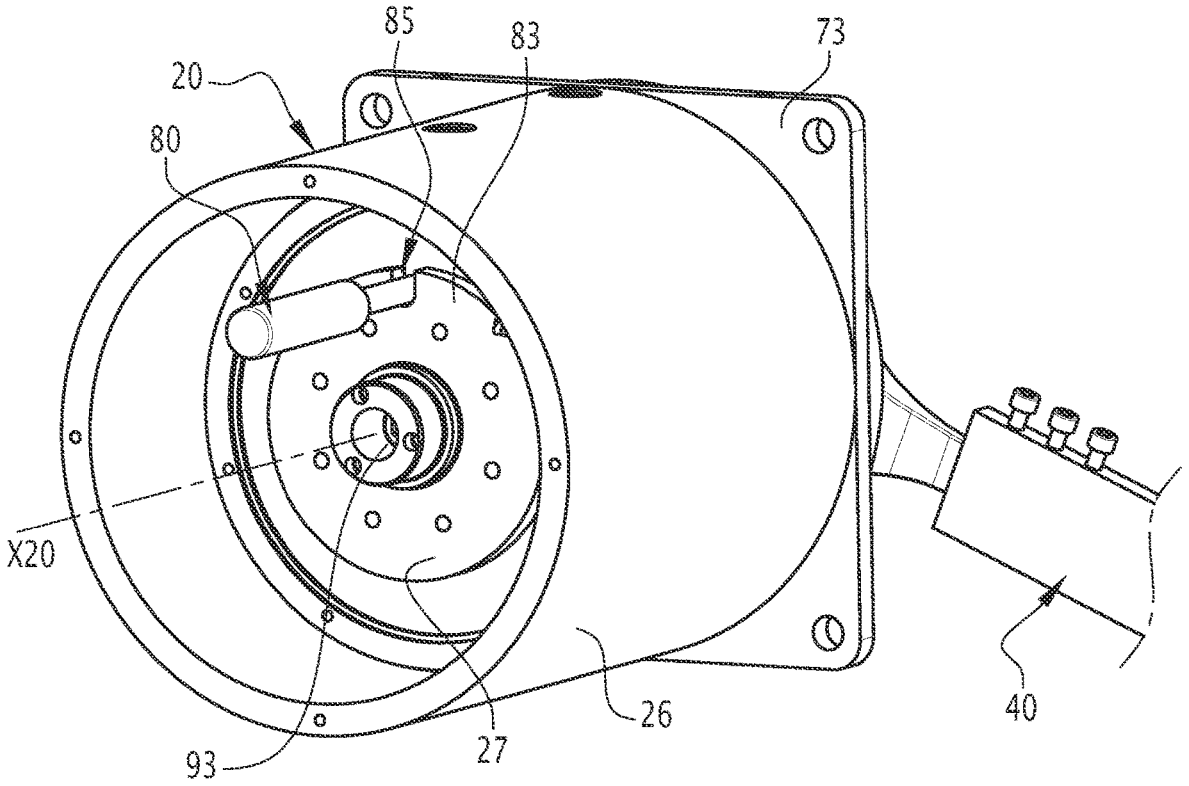
FIG. 9 is a perspective view of the back of the actuator of FIG. 8.

As visible in FIGS. 8 and 9, it is advantageously provided that the screw 93 extends through the actuator 20, so that a head of the screw 93 emerges at one end of the actuator 20, which is opposite to the one carrying the flange 36. The head of the screw 93 is therefore very easily accessible for a person, who needs to switch the adjustment system between the adjustment configuration and the locked configuration, by screwing or unscrewing the screw 93 by means of its head.

FIG. 4 shows a case 4A corresponding to a maximum amplitude adjustment configuration, where the linkage 32 is positioned so that the distance R1 takes a maximum eccentric center distance value, and a case 4B corresponding to a minimum amplitude adjustment configuration, where the linkage 32 is positioned so that the distance R1 takes a minimum center distance value. FIG. 10 shows a case 10A corresponding to a maximum amplitude adjustment configuration, where the linkage 32 is positioned so that the distance R1 takes a maximum eccentric center distance value, and a case 10B corresponding to a minimum amplitude adjustment configuration, where the linkage 32 is positioned so that the distance R1 takes a minimum center distance value.

Preferably, the adjustment system comprises the amplitude adjustment stops, to limit the movement, in other words, here the movement in translation along the R32 axis, of the linkage 32 relative to the base 31, along the axis X32, between the position shown in cases 4B and 10B where the distance R1 takes the minimum eccentric center distance value and the position shown in cases 4A and 10A, where the distance R1 takes the maximum eccentric center distance value. Preferably, the movement of the linkage 32 is therefore only between these two predetermined positions, without going beyond them. Preferably, in practice, the adjustment of the amplitude of the stroke Cl is carried out for values of the distance R1, which are lower than the maximum value and higher than the minimum value, whereas the distance R1 is brought to the maximum and minimum values only for the control steps, for example controlling the tightening. Thus, in the locked configuration, the value of the distance R1 is always at a value that is less than the maximum value and greater than the minimum value, and the amplitude adjustment stops are not stressed.

In the present example, to form the amplitude adjustment stops, the rod 78, in particular the nut 94, abuts against ends of the oblong opening 77. This is particularly visible in FIG. 4, where in case 4A, the nut 94 abuts a first end of the oblong opening 77 along the axis R32, and where in case 4B, the nut 94 abuts the second end of the oblong opening 77, in the opposite direction, along the axis R32.

As illustrated in FIGS. 1, 2, 3 and 11, in order to allow the connecting rod center distance R2 to be variable, the articulation ends 41 and 42 of the connecting rod are movable relative to each other. The adjustment system comprises locking means for selectively allowing this movement, to achieve the height adjustment configuration, and prohibiting this movement, to achieve the locked configuration or the amplitude adjustment configuration.

In the present example, in order for the connecting rod center distance R2 to be adjustable when the adjustment system is in the height adjustment configuration, the ends 41 and 42 slide relative to each other, along a sliding axis R40 intersecting the axes X41 and X42, or at least parallel to the connecting rod 40. For example, the connecting rod 40 comprises a connecting rod stem 44, carrying the articulation end 41, and a connecting rod sleeve 45, carrying the articulation end 42. Preferably, the stem 44 is slidably fitted into the sleeve 45. For this purpose, the sleeve 45 is, for example, in the form of a sleeve to receive the stem 44, which presents the form of a stem integral with the circular flange, and to guide its sliding along the axis R40.

To form the locking means of the adjustment system, it is, for example, provided that the connecting rod 40 comprises a yoke 96, a shoe 97 and at least one clamping screw 98, here there are three. The head of the screws 98 is accessible from the outside of the connecting rod 40. The yoke 96 and the shoe 97 are arranged inside the sleeve 45 of the connecting rod and together constitute a clamp for locking the stem 44 of the connecting rod. The yoke 96 and the shoe 97 are arranged in a pincer-like manner on either side of the stem 44. The shoe 97 is fixed relative to the sleeve 45 and is interposed between a wall of the sleeve and the stem 44 of the connecting rod. The yoke 96 is arranged between the other wall of the sleeve and the stem 44 of the connecting rod, being movable in translation in a direction perpendicular to the axis R40, between a clamped position, where the stem 44 is clamped between the yoke 96 and the shoe 97, so that the stem 44 is immobilized along the axis R40 relative to the sleeve 45, and a released position, where the stem 44 is sufficiently loosened to be able to slide. Screwing in the clamping screws 98 moves the yoke 96 to the clamped position. Loosening the clamp screws 98 allows the yoke to return to its loose position.

Figure 11:
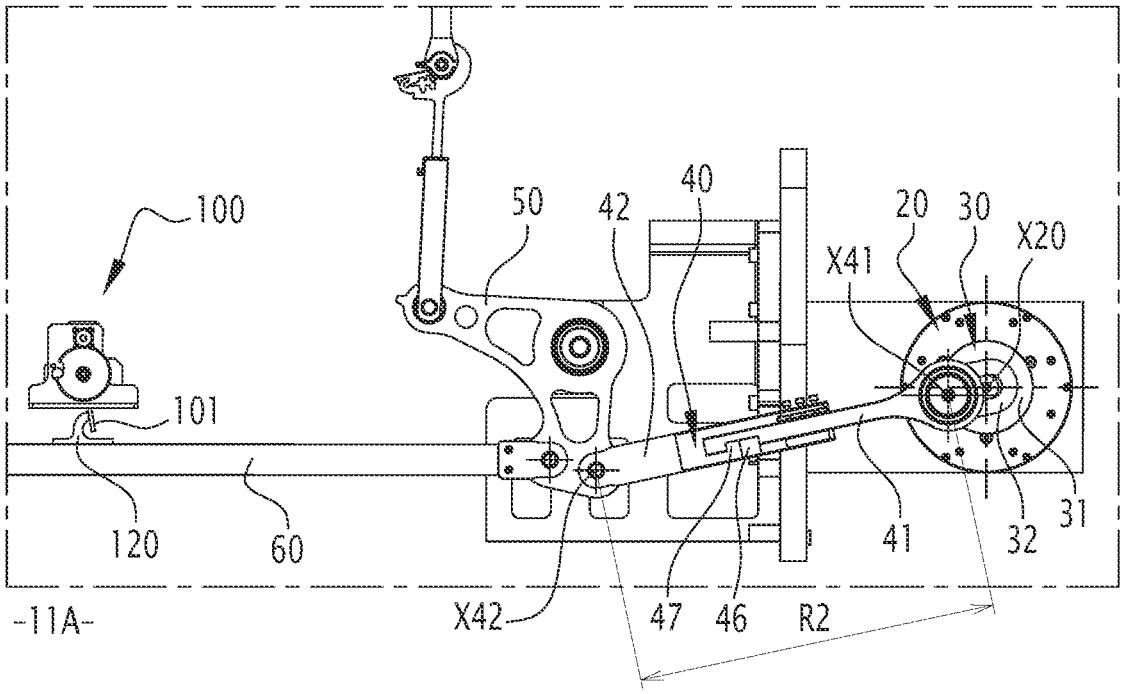
FIG. 11 shows two partial front views 11A and 11B of the same elements as in FIG. 2, in a height adjustment configuration.
Figure 11:
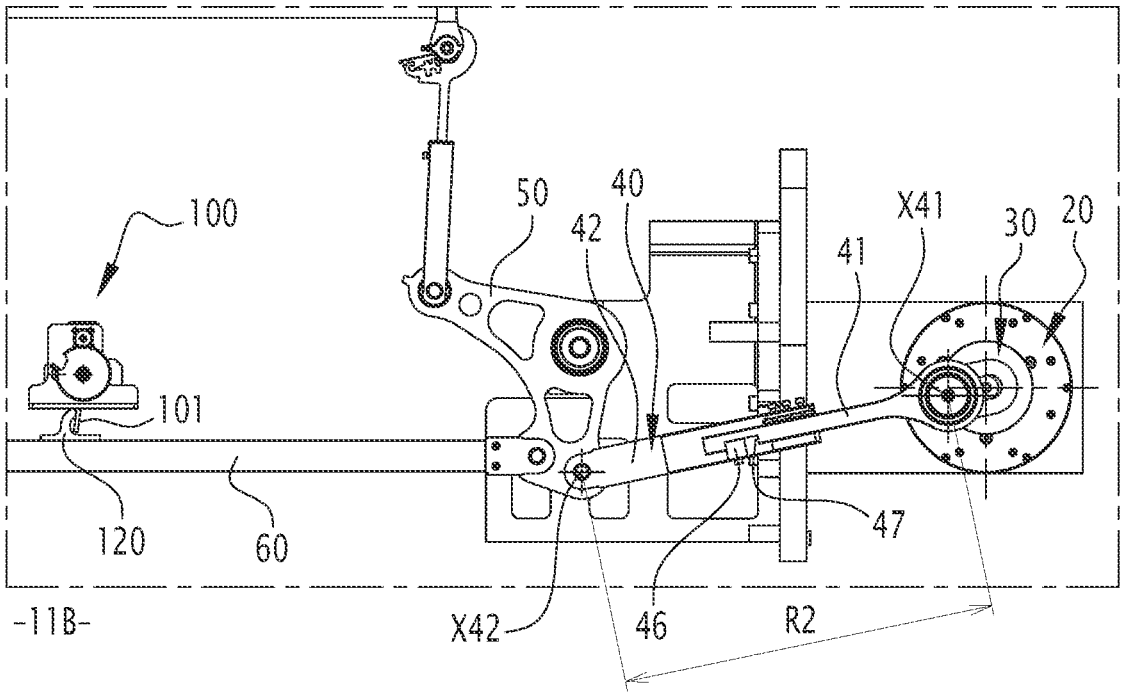

FIG. 11 shows a case 11A corresponding to a minimum height configuration, where the ends 41 and 42 are arranged so that the distance R2 takes on a minimum connecting rod center distance value, in other words, corresponding to the case where the stroke C11 is shifted to its lowest height relative to the reference position P11. FIG. 11 shows a case 11B corresponding to a maximum height configuration, where the ends 41 and 42 are arranged so that the distance R2 takes a maximum connecting rod center distance value, in other words, corresponding to the case where the stroke C11 is shifted to its highest height relative to the reference position P11.

Preferably, the adjustment system comprises height adjustment stops, to limit the movement, which is here the sliding, of the ends 41 and 42 along the axis R40, between the position shown at 11A where the distance R2 takes the minimum value of the connecting rod center distance and the position shown at 11B where the distance R2 takes the maximum value of the connecting rod center distance. The relative movement of the ends 41 and 42 is therefore only between these two positions, without going beyond them. For example, in order to constitute the height adjustment stops, the sleeve 45 comprises a stop 46, formed by a parallelepipedal block fixed by screws on the inside of the sleeve, and the stem 44 comprises a groove, forming two shoulders 47 facing each other, framing the stop 46. Preferably, in practice, the adjustment of the height of the stroke Cl is carried out for values of the distance R2, which are lower than the maximum value and higher than the minimum value, while the distance R2 is only brought to the maximum and minimum values for the control steps, for example the clamping control. Thus, in the locked configuration, the value of the distance R2 is always at a value that is less than the maximum value and greater than the minimum value, and the height adjustment stops are not stressed.

As shown in FIG. 11 for cases 11A and 11B, the stop 46 alternately abuts against either of the shoulders 47, so that the sliding stroke of the ends 41 and 42 is limited. The stop 46 moves freely between the shoulders 47 to obtain the intermediate values of the distance R2.

Preferably, the adjustment system comprises a set of amplitude adjustment graduations, indicating an amplitude adjustment value depending on the eccentric center distance R1. In this case, the set of graduations is, for example, marked on the base 31 while a reference mark is marked on the linkage 32, or vice versa. Preferably, the adjustment system comprises a set of height adjustment graduations, indicating an amplitude adjustment value depending on the connecting rod center distance R2. In this case, the set of graduations is, for example, marked on the connecting rod stem 44, while the edge of the sleeve 45 serves as a reference mark.

In the locked configuration of the adjustment system, used in particular when weaving with the loom 1, the rotation of the eccentric system 30 about the axis X20 relative to the frame 12 by the actuator 20, causes the heald frame 11 to move, by means of the pulling mechanism. While the rotation of the eccentric system 30 is carried out without changing the direction, the levers 50 and 70 pivot in oscillation and the heald frame 11 is in reciprocating translation. With each complete revolution of the eccentric system 30 about the axis X20 relative to the frame 12, the levers 50 and 70 have pivoted in one direction and then in the other and returned to their initial position, and the heald frame 11 has traveled the stroke C11 in both directions and returned to its initial position. In detail, when the eccentric system 30 makes a first half turn, the heald frame 11 is driven from the low end position B11 to the high end position H11. When the eccentric system 30 continues to rotate without changing direction, the heald frame 11 is driven in the opposite direction from the high end position H11 to the low end position B11.

As visible in FIGS. 8 and 9, the shedding machine 2 comprises a locking system 80. In the present example, an individual locking system 80 is provided for each shedding machine 2. The locking system 80 allows for a locking configuration shown in FIGS. 8 and 9 and a release configuration.

In the locking configuration, the locking system 80 immobilizes the base 31 about the axis X20 at a reference orientation. In other words, the base 31 is immobilized about the axis X20 relative to the stator 26. The reference orientation is preferably that shown in FIGS. 1, 2, 10 and 11 and is adopted for the adjustment configuration. It is provided that, when the base is in the reference orientation, the R32 axis is parallel to the X40 axis. In other words, in the reference orientation, the axes X41, X42 and X20 are coplanar. Preferably, in the reference orientation, the axes X42, X41 and X20 are arranged in this order, that is, with axis X41 between the axes X20 and X42, as shown in FIGS. 1 and 2. Alternatively, it is provided that in the reference orientation, the axes X42, X20 and X41 are arranged in that order, that is, with the axis X20 between the axes X42 and X41. Preferably, the reference orientation is chosen to correspond to the case where the heald frame 11 is positioned in an end position, preferably in a high end position H11, to correspond to a situation where the heald frame 11 tends to move the connecting rod 60 in the opposite direction of a direction d101, defined below, under the effect of gravity.

Another remarkable orientation is also defined for the base 31, so-called "clearance orientation", in which the axes X41, X20 and X42 are also coplanar, but being arranged in a reverse order relative to their arrangement when the base 31 is in the reference orientation. In the example case where the reference orientation of the base 31 arranges the axes X42, X41, and X20 in that order, the clearance orientation arranges the axes X42, X20, and X41 in that order, that is, the axes X20 and X41 are reversed. Preferably, the clearance orientation corresponds to a half turn of the base 31 relative to the reference orientation. Preferably, when the base 31 is in the clearance orientation, the heald frame 11 is in the low end position B11.

Alternatively, if the reference orientation is provided to align axes X41, X20, and X42 in that order, then the clearance orientation aligns the axes X20, X41, and X42 in that order.

Alternatively, it could be intended that the reference orientation corresponds to a B11 positioning of the frame, while the clearance orientation corresponds to a H11 positioning.

In the release configuration, the locking system 80 does not oppose the pivoting of the base 31, in particular under the action of the actuator 20.

As illustrated in FIGS. 8 and 9, the locking system 80 comprises a pin 81, an indexing housing 82 and a flange 83. In FIGS. 8 and 9, the locking system 80 is shown in the locking configuration. In FIG. 9, the indexing housing 82 is omitted to show the flange 83.

The indexing housing 82 is integral with the stator 26. The indexing housing 82 is arranged at the rear of the actuator 20, in particular at the rear of the stator 26, that is, opposite the eccentric system 30 along the axis X20. The flange 83 is integral with the rotor 27. The flange 83 is arranged at the rear of the actuator 20, in particular at the rear of the rotor 27, that is, opposite the eccentric system along the axis X20. As the flange 83 is integral with the rotor 27, it is integral in rotation with the output shaft 28 and the base 31 about the axis X20. The flange 83 is advantageously arranged between the indexing housing 82 and the base 31, along the axis X20. Both the indexing housing 82 and the flange 83 are centered on the X20 axis. If the screw 93 is provided, it can be provided that the indexing housing 82 and the flange 83 each comprise a central opening to allow the technician to access the screw head from the rear end of the actuator 20 through the housing 82 and the flange 83. In this present example, the housing 82 constitutes a rear wall of the stator 26 and carries a roller bearing to support the rotation of rotor 27 about axis X20. The flange 83, in turn, constitutes a rear portion of the rotor 27, received within the bearing carried by the housing 82.

Advantageously, the housing 82 comprises an opening 84, which passes through the housing 82 along an axis parallel to the axis X20 and not coaxial with the axis X20. In other words, the opening 84 is eccentric relative to the axis X20. The pin 81 passes through the opening 84, so as to be supported by the housing 82, sliding through the opening 84, parallel to the axis X20, relative to the housing 82.

The flange 83 comprises a notch 85, which is arranged radially relative to the axis X20. When the base 31 is in the reference orientation, shown in FIGS. 8 and 9, the notch 85 is aligned with the opening 84, so that the opening 84 and the notch 85 have an axis through them, which is parallel to the axis X20. In this orientation, the pin 81 can be slid to a locking position, shown in FIGS. 8 and 9, where a forward end of the pin 81 is received in the notch 85. Then, the pin 81 prevents the rotation of the flange 83, and thus the base 31, about the axis X20. In other words, the locking system 80 is in a locking configuration. The pin 81 can be slid to a release position, or even withdrawn from the actuator 20, by being slid away from the base 31, that is, toward the rear of the actuator 20. In the absence of the pin 81, or when the pin 81 is in the release position, the front end of the pin 81 is clear of the notch 85, so that the pin 81 does not interfere with the rotation of the flange 83 and the base about axis X20. The locking system 80 is then in the release configuration.

Advantageously, the actuator 20 comprises a cover 86, shown in FIG. 8, which covers the housing 82 and the flange 83 and, more generally, closes the rear of the actuator 20.

Preferably, as shown in FIG. 8, the cover 86 comprises an opening that the pin 81 passes through when the pin is in the locked position, so that the pin 81 is accessible to the technician from outside the actuator 20 and can be operated without opening the cover 86.

Alternatively, it can be provided that the housing 82 comprises a plurality of openings 84, arranged at different indexing positions about the axis X20, so that the pin 81 can be inserted, as desired, within one of these openings 84. The cover 86, if provided, then includes corresponding holes for the pin 81 to pass through. Depending on which opening 84 receives the pin 81 in the locking position, locking of the base 31 is achieved according to several different orientations, including the aforementioned reference orientation.

It is provided that the locking system 80 is in a release configuration for weaving. It is provided that the locking system 80 is in the locking configuration when the adjustment system is in the adjustment configuration.

Alternatively, as represented by FIGS. 21, 22, 23 and 24 a locking system 180 can be provided, in place of the aforementioned locking system 80. The locking system 180 is a system of indexing fingers, comprising a finger 181, which ensures the same function as the aforementioned pin 81. The locking system 180 further comprises the same indexation housing 82 and the same flange 83 as previously described.

The finger 181 passes through the opening 84 of the housing 82, so as to be supported by the housing 82, by sliding through the opening 84, parallel to the axis X20, relative to the housing 82. The finger 181 also passes through the cover 86, so as to be able to be actuated by the technician from outside the actuator 20 without opening the cover 86. The opening 84 of the housing 82 guides the sliding of the finger 181, here parallel to the axis X20, between a release position, shown in FIGS. 21 and 22, and a locking position, shown in FIGS. 23 and 24, so as to be similar to the aforementioned pin 81.

When the base 31 is in the reference orientation, the notch 85 is aligned with the finger 181. The finger 181 can then slide up to the locking position, where a front end of the finger 181 is received in the notch 85. The finger 181 thus prevents the rotation of the flange 83 and therefore the base 31, about the axis X20. In other words the locking system 180 is in the locking configuration. The finger 181 can also slide up to the release position, preferably without being able to be withdrawn from the actuator 20, by sliding away from the base 31, in other words, toward the rear of the actuator 20. In the release position, the front end of the finger 181 is released from the notch 85, so that the finger 181 does not prevent the rotation of the flange 83 and the base about the axis X20. The locking system is thus in the release configuration.

It can advantageously be provided that the locking system 180 comprises a shutter 187, carried at the rear of the actuator 20, for example on a cable box 188 carried by the wall 86. The cable box 188 is fixed to the wall 86, for example, by means of four screws.

Figure 21:
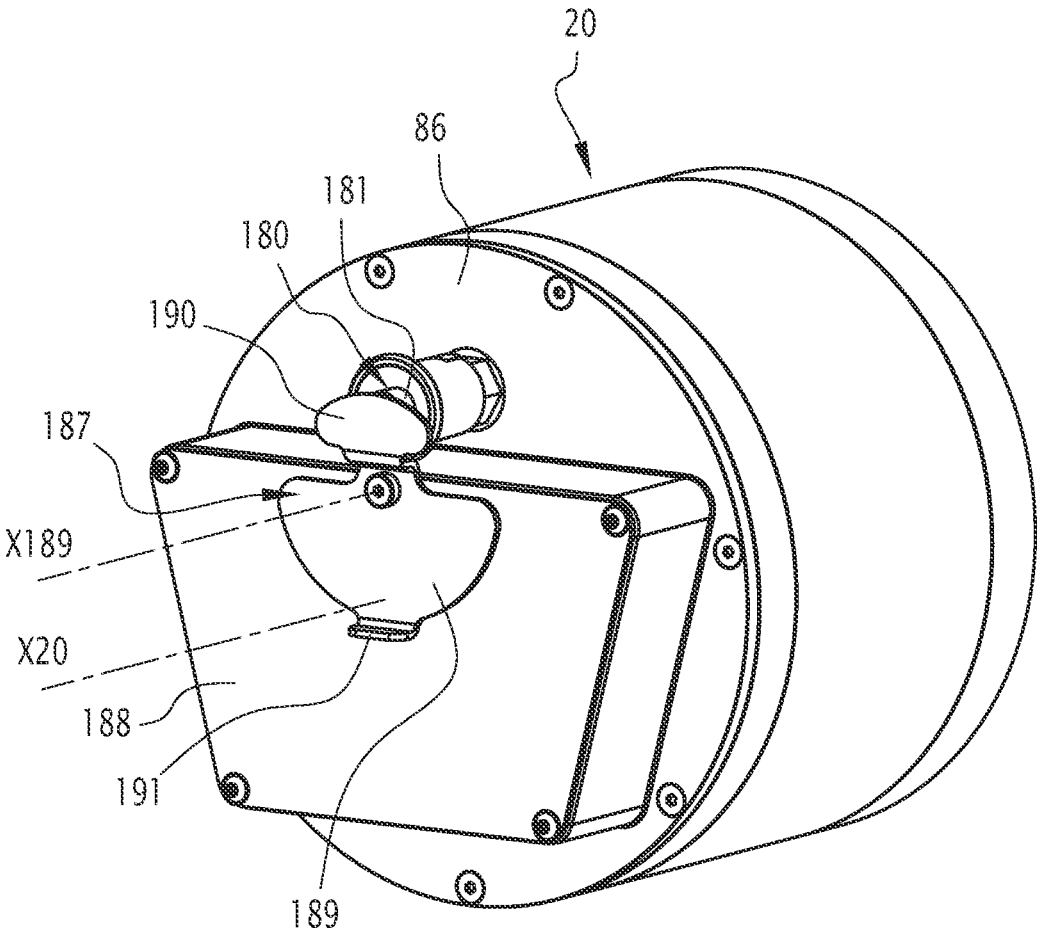
FIG. 21 is a view of the back of a rotary electric actuator where a shutter is in a nominal position, in other words a weaving position.
Figure 22:
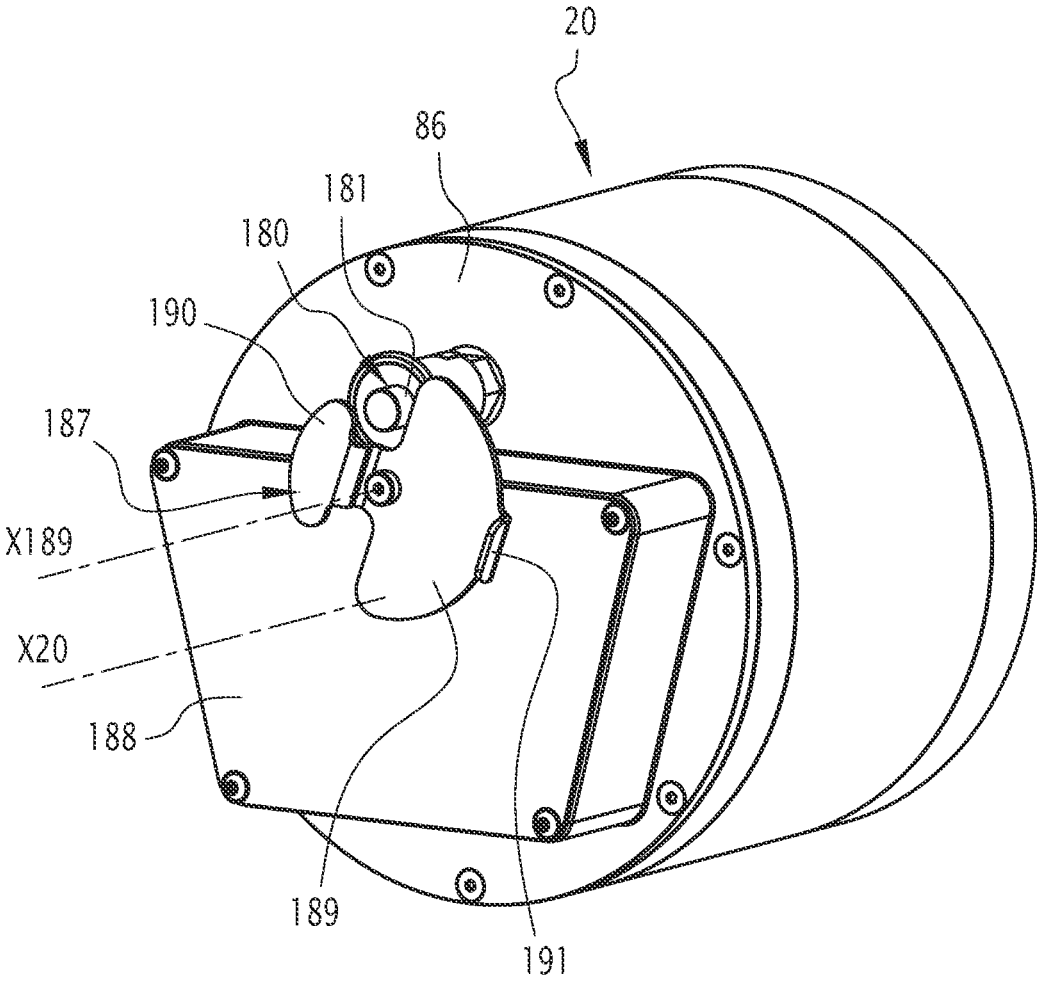
FIG. 22 is a view similar to that of FIG. 21 where the shutter is in a first balance position and the locking system is in the release configuration.
Figure 23:
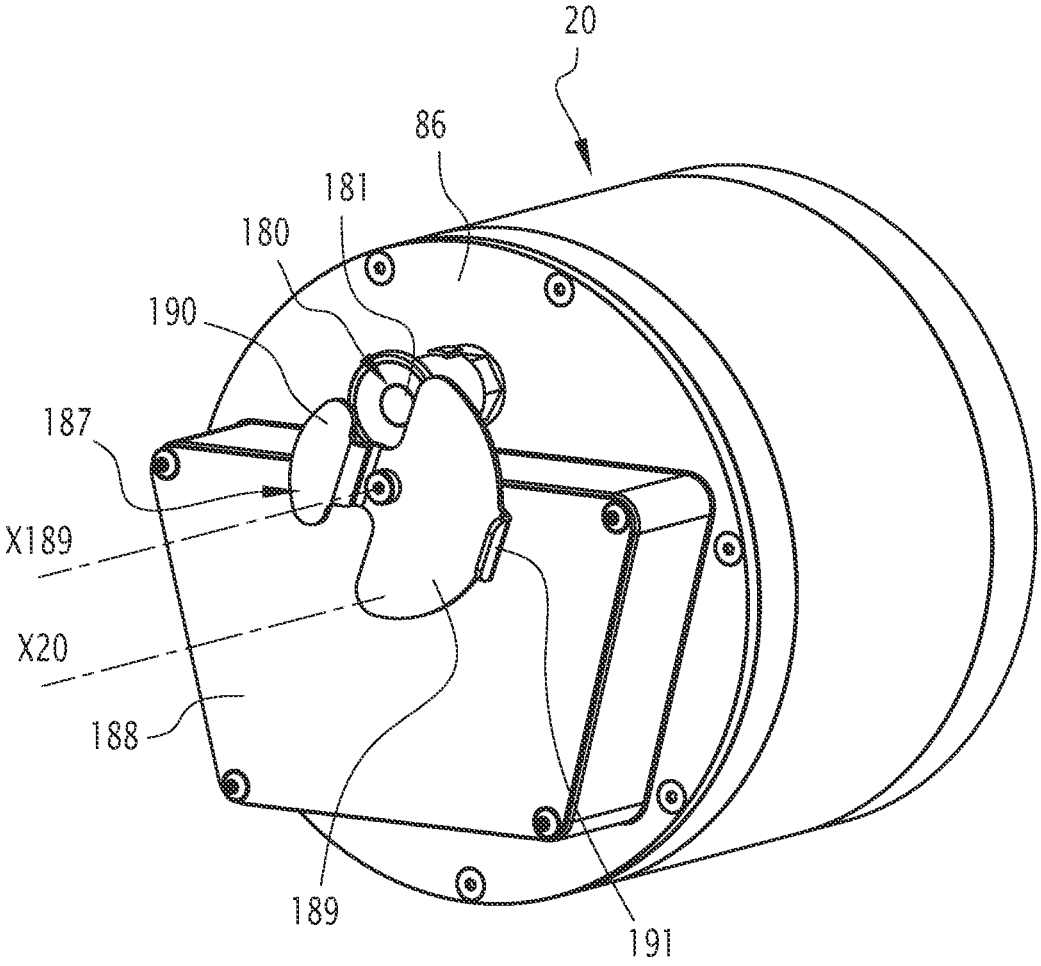
FIG. 23 is a view similar to that of FIG. 21 where the shutter is in a first balance position and the locking system is in the locking configuration.
Figure 24:
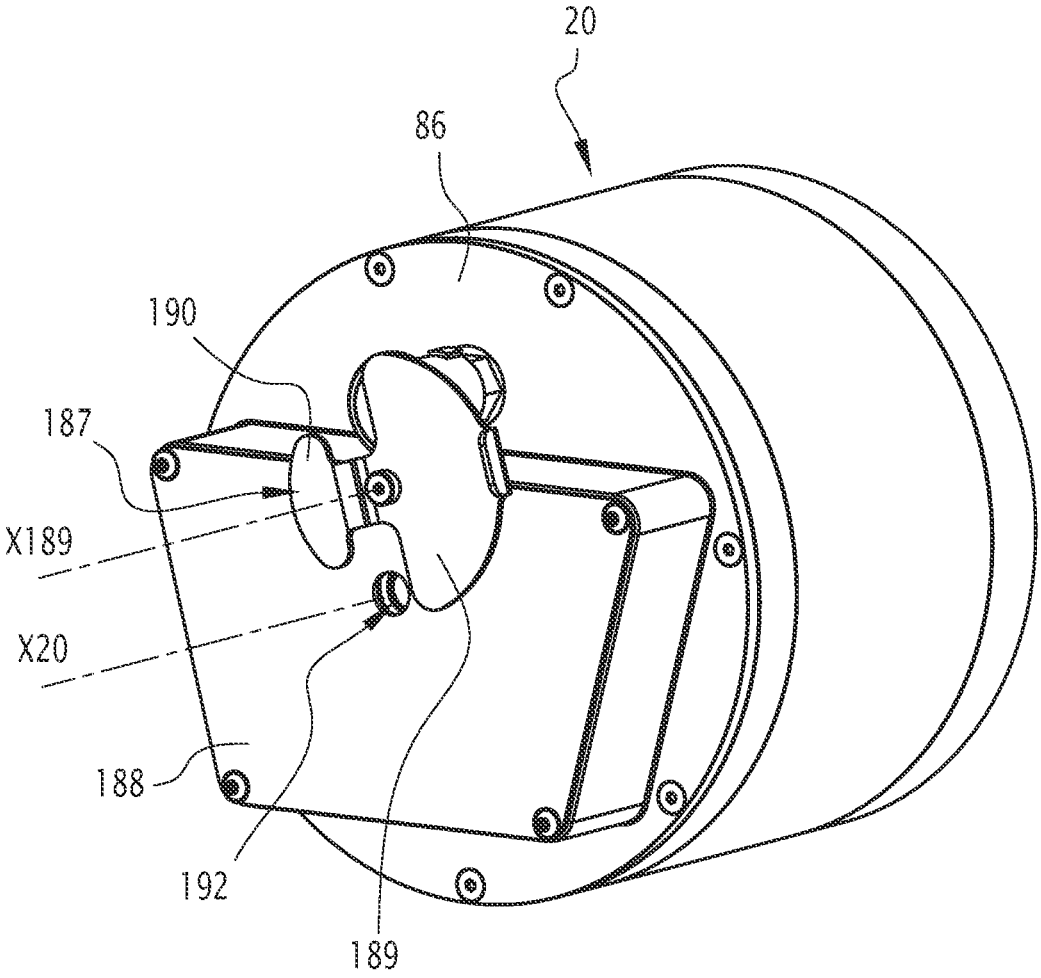
FIG. 24 is a view similar to that of FIG. 21 where a shutter is in a second balance position and the locking system is in the locking configuration.

The shutter 187 is pivotable relative to the stator 26, to the housing 82 and the wall 86, about an axis X189 parallel to the axis X20, between a nominal position, shown in FIG. 21, a first balance position, shown in FIGS. 22 and 23, and a second balance position, shown in FIG. 24.

The shutter comprises a first lobe 189 and a second lobe 190, symmetrically opposed relative to the axis X189. The lobe 189 extends along a first plane perpendicular to the axis X189 and the lobe 190 extends along a second plane perpendicular to the axis X189, the second plane being offset towards the rear relative to the first. In other words, along the axis X189, the lobe 190 is further from the wall 86 than the lobe 189. The lobes 189 and 190 thus define between them two radial indentations. The size of these radial indentations allows access for a tool such as a screwdriver, or the finger of the technician, in the radial indentations. Advantageously, the shutter 187 comprises an extreme fold 191, carried here by the lobe 189, which facilitates the holding and rotation of the shutter by the technician.

Being closer to the wall 86, the lobe 189 interferes with the finger 181 when the finger 181 is in the release position. In particular, even though the shutter is in the nominal position or in a first tipping position, the finger 181 in the release position prevents the shutter 187 from being pivoted to the second tipping position, as the lobe 189 radially presses against the finger 181, while passing over the lobe 190 along the axis X189. Furthermore, when the shutter 187 is in the second tipping position as shown in FIG. 24, it covers the finger 181, then in the locking position, thus preventing the actuation of the finger 181 by the technician and/or opposing the movement of the finger 181 into a release position.

Being further from the wall, the lobe 190 does not interfere with the finger 181, whether it is in the release position or the locking position. However, in the nominal position, as shown in FIG. 21, the lobe 190 covers the finger 181, whether it is in the release position or the locking position, to prevent the technician from actuating the finger 181. In other positions of the shutter 187, such as those shown in FIGS. 22 to 24, the lobe 190 is offset relative to the Finger 181.

The finger 181 can only be actuated by the technician when it is aligned axially with one of the radial indentations of the shutter 187, so as not to be covered by one of the lobes 189 and 190, in particular in the first tipping position as shown in FIGS. 22 and 23.

Alternatively, but not shown, it is provided that the locking system is a pinning system formed by a pin moveable in translation in a sleeve, integral with the cover 6 and grooved in an "L" in which a peripheral lug of the pin is able to confirm an axial sunken position of the pin when in locking configuration.

Alternatively, but not shown, it is provided that the locking system is a system of pneumatic or electric indexing fingers able to be actuated, for example by remote control.

The loom also comprises an adjustment device 100, visible in particular in FIGS. 1, 2, 6, 7, 10 and 11. The adjustment device 100 has the function of performing the adjustment of the shedding machine 2, in the case where the machine 2 is in the height adjustment configuration and in the case where the machine 2 is in the amplitude adjustment configuration, and while the locking system 80 is in the locking configuration. For this purpose, the adjustment device 100 is able to actuate the respective connecting rods 60 of the machines 2 in the adjustment configuration. In order to be actuated by the adjustment device 100, each connecting rod 60 is equipped with a respective follower member 120.

Advantageously, only one adjustment device 100 is provided, which is shared between the machines 2. However, several adjustment devices 100 could be provided, each devoted to the adjustment of one or more machines 2.

The adjustment device 100 mainly comprises a flap 101, for moving the connecting rods 60 by means of their respective follower member 120, as well as a flap actuator 102, for actuating the flap 101. Advantageously, the device 100 comprises a chassis 104. The adjustment device 100 is positioned close to the connecting rods 60, for example above the connecting rods 60, as shown in FIGS. 1 and 2.

The chassis 104 is a fixed part relative to the frame 12, being integral with the structure of the loom. The chassis 104 supports the flap 101 and the actuator 102. The chassis 104 comprises two brackets, each formed by a folded sheet of metal. Each of these brackets is connected to a respective fixed crossbeam, belonging to the loom, not represented. The brackets are arranged on either side of the connecting rod assembly 40, parallel to the axis X20.

The flap 101 is supported by the chassis 104, being pivotal relative to the chassis 104 about an axis X101, called "control axis". The axis X101 is advantageously parallel to the axes X20, that is, perpendicular to the planes of the heald frames 11 and to the connecting rod planes P60. In practice, the flap 101 extends from one of these brackets to the other of these brackets, being supported pivotally about the axis X101 by the brackets, at its axial ends. To this end, each bracket carries a respective bearing centered on the axis X101 for supporting one of the ends of the flap 101. By pivoting, the flap 101 is configured to move one or more connecting rods 60 by driving the follower member 120 fitted to the or the relevant connecting rod(s) 60. Thus, the flap 101 can adjust the distance R1, in the case where the adjustment system is in the amplitude adjustment configuration, and the distance R2, in the case where the adjustment system is in the height adjustment configuration.

Advantageously, the flap 101 presents the form of a rectangular plate of constant thickness. The flap 101 presents a proximal edge 106 and a distal edge 107 parallel to the axis X101 and opposite to each other. The distal edge 107 is located on the side of the connecting rods 60, relative to the control axis X101, and the proximal edge 106 is located opposite relative to the axis X101.

Preferably, parallel to the axis X101, and therefore to the axis X50, the flap 101 extends from the first of the connecting rods 60, to the last of the connecting rods 60 of the set of connecting rods 60. In other words, along the axis X101, one axial end of the flap 101 is at the height of the first of the connecting rods 60, and another axial end of the flap 101 is at the height of the last of the connecting rods 60, so that all of the connecting rods 60 can be actuated by the flap 101. In other words, the flap 101 passes through all of the connecting rod planes P60 of the shedding assembly. Along the axis X101, the brackets of the chassis 104 are therefore positioned on either side of the connecting rods 60 so that the flap spans all the connecting rods 60. The same flap 101 can therefore reach and drive all the follower members 120.

Preferably, all the follower members 120 are positioned at the same place on their respective connecting rod 60 so that they can be indifferently actuated by the flap 101. This also allows several connecting rods 60 to be actuated at the same time in the same way, with the same flap 101, if required. By operating several follower members 120 at the same time, the levers 50 and 70 and the corresponding heald frames 11 are moved simultaneously to the same positions. This also ensures that all follower members are aligned along the same axis parallel to axis X101 when the shedding machines 2 are put into a leveling configuration. Also, this allows all the follower members to be restrained, for example, in an emergency situation of the loom, to prevent the frames from falling due to the effect of gravity.

Figure 6:
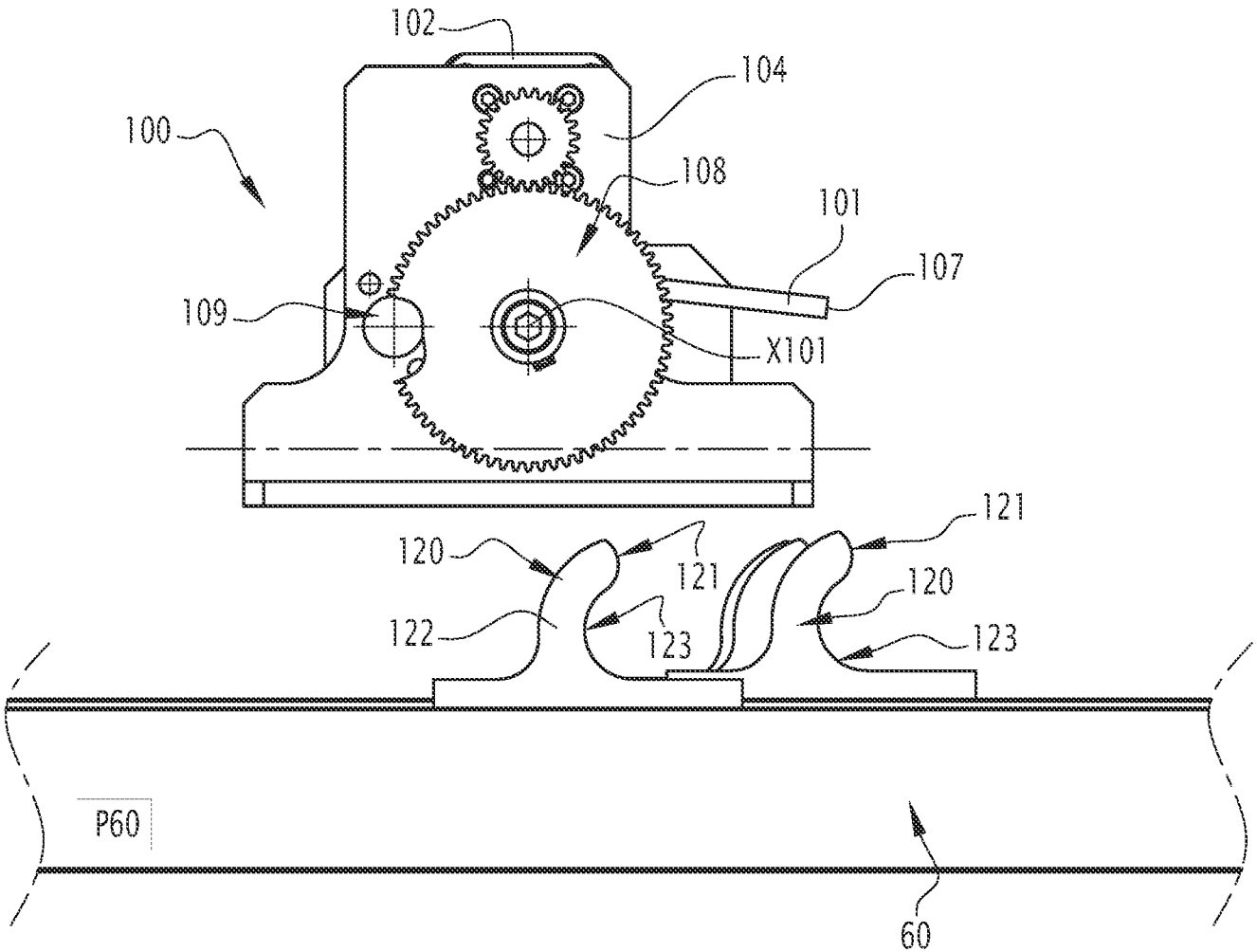
FIG. 6 is a front view of an adjustment device, where a flap is in a release position.
Figure 7:
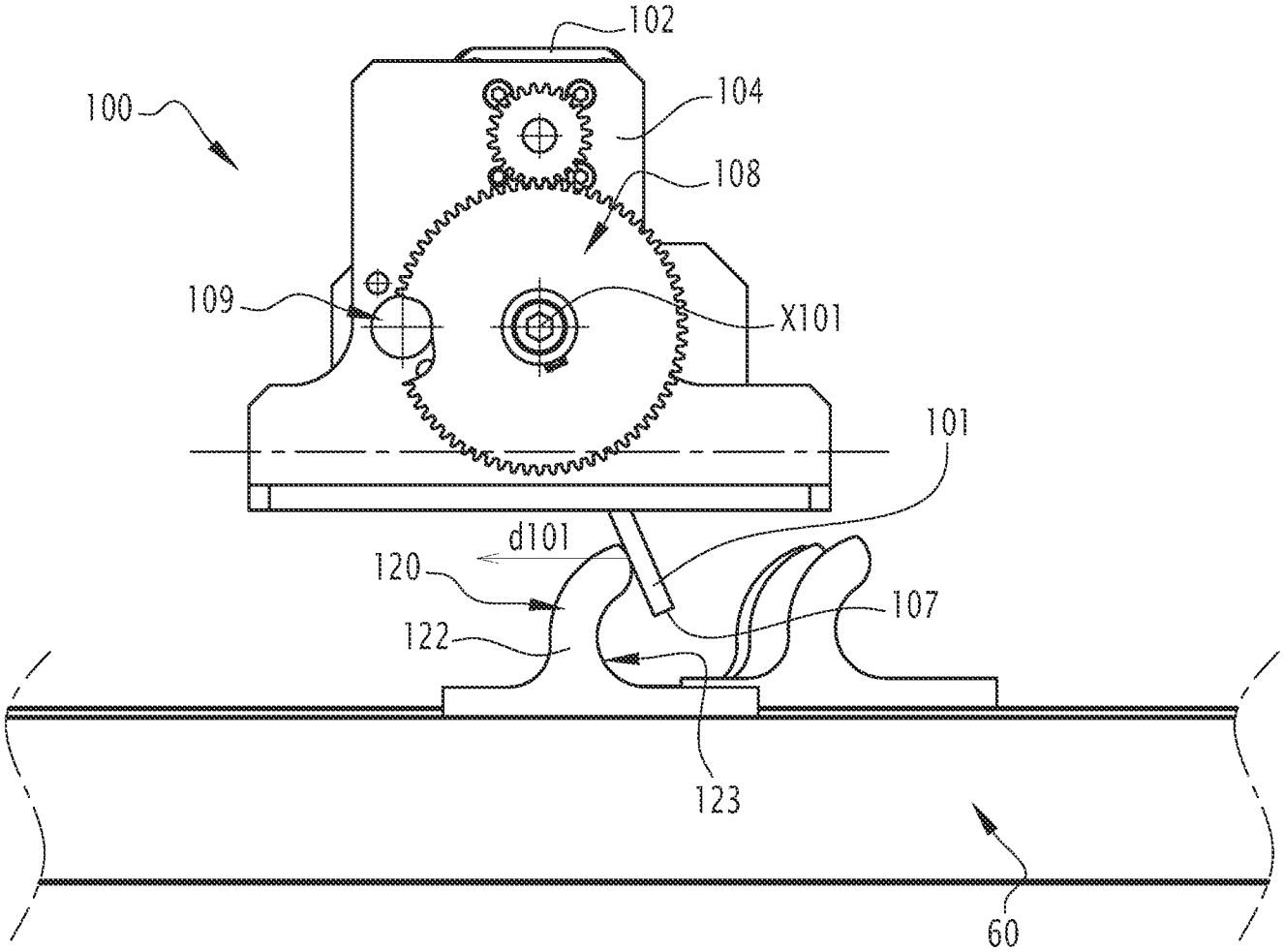
FIG. 7 is a view similar to FIG. 7, where the flap is in a reference position.

Each follower member 120 presents advantageously in the form of a follower finger, as clearly visible in FIGS. 6 and 7. The follower finger is, for example, cut out of a piece of sheet metal, the thickness of which is close to or less than that of the connecting rod 60 or the heald frame 11, the thickness being measured parallel to the axis X101. The follower member 120 extends along the connecting rod plane P60 of the connecting rod 60 that it equips. The follower member 120 is integral with the connecting rod 60, for example by being screwed to it. The follower member 120 projects from the connecting rod 60 perpendicular to the axis X101, in the direction of the heald frame 11, that is, in the direction of the device 100. In particular, the follower member 120 is carried on one edge of the connecting rod 60, here the upper edge. Alternatively, the follower member may extend perpendicular to the connecting rod 60. Alternatively, the follower member may be defined by another profile.

By pivoting about the axis X101, the flap 101 is movable between a release position, shown in FIG. 6, and working positions, one of which is shown in FIG. 7.

As shown in FIG. 7, in the working position, the flap 101 is in abutment with at least one of the follower members 120, to drive that follower member 120. The flap 101 is moved to one of the working positions while the shedding machine 2 is in the adjustment configuration and the locking system 80 is in the locking configuration, so that the flap 101 adjusts the distance R1 or R2 of the shedding machine 2 by driving the follower member 120. The flap is then given a working position corresponding to the desired adjustment of the distance R1 or R2, according to a method detailed below. In this working position, the flap 101 presses against the follower member 120 in the direction of a direction d101, called "retaining direction". In other words, the flap 101 presses against the follower member 120 along the retaining direction d101. The direction d101 is parallel to the connecting rod 60, or close to being parallel to the connecting rod 60. The orientation of the retaining direction d101 depends on the contact maintained by the flap 101 on the profile of the follower member 120 in the working position. In the present example, the direction d101 is oriented in a direction from the lever 50 toward lever 70. The direction d101 is parallel to the plane P60. Advantageously, it is provided that the flap 101 is pressed only in this direction, and not, for example, in the opposite direction. Therefore, the design of the adjustment device 100 can remain relatively simple.

In practice, the flap 101 retains the connecting rod 60 by means of the follower member 120, against forces applied by the heald frame 11, under the effect of gravity, on the levers 50 and 70, and tending to move the connecting rod 60 in the opposite direction of the direction d101. In practice, the heald frame 11 tends to move downward, along the axis Z11, under the effect of gravity and possibly other forces acting within the loom, such as, for example, the weight and/or the tension of the warp threads. In the present example, given the arrangement of the connections linking the frame to the levers 50 and 70, this lowering of the heald frame 11 leads to a rotation of the levers 50 and 70, via the connecting rods 17 and 18, in a direction that tends to move the connecting rod 60 in the opposite direction of the direction d101. Thanks to this, it is certain that the flap 101 is maintained in contact with the follower member 120, so that the flap 101 can actuate the connecting rod in the direction d101 and in the opposite direction. Advantageously, in the position H11, the tension of the warp threads tends to maintain the contact of the flap on the follower member because the warp threads then act on the heald frame 11 in the same direction as the effect of gravity. On the contrary, in a configuration of adjustment of the heald frame 11 from its position B11, the tension of the warp threads tends to move the frame in the opposite direction of gravity, which would make it lose contact between the follower member and the flap. Preferably, the warp tension is adjusted so as to be reduced during the shedding adjustment operations to ensure that contact between the follower member and the flap is maintained under the effect of gravity when the flap is near the position B11, but not excessive when the frame is near the position H11.

As shown in FIG. 6, in the release position, the flap 101 is oriented in a released manner relative to all the follower members 120, that is, in a position where the follower members 120 do not come into contact with the flap 101, regardless of the position of the corresponding connecting rods 60. The release position is adopted in particular in locked configuration and in particular during weaving, so that the flap 101 cannot come into contact with the follower members 120 and hinder the movement of the machines 2. The release position is achieved by moving the flap 101 in the opposite direction to the retaining direction d101. In other words, in the release position, the edge 107 is arranged opposite to the retaining direction d101 relative to the position adopted by the edge 107 when the flap 101 is in the working position. The flap 101 does not interfere with the movement of the frame between its positions H11 and B11.

In the present example, the follower member 120 comprises an end portion defining a guide profile 121 and a foot 122 defining a release profile 123. The profiles 121 and 123 face away from the direction d101. The follower member 120 is integral with the connecting rod 60 by means of the foot 122.

The guide profile 121 is convex in the connecting rod plane P60. As shown in FIG. 7, in order to drive the connecting rod 60 via the follower member 120, the flap 101 presses against the guide profile 121 in the direction d101, at different pressure points of the guide profile 121 depending on the orientation of the flap 101 about the axis X101. As shown in FIG. 7, it is advantageously provided that it is a flat face of the flap 101 that presses against the member 120.

The release profile 123 is concave in the connecting rod plane P60 and extends between the guide profile 121 and the connecting rod 60. Because of the form of the profiles 121 and 123, the follower member 120 presents a general hook shape, in the plane P60. The profile 123 receives the edge 107 of the flap 101 when the flap 101 presses against the guide profile 121. Thus, whatever the orientation of the flap 101, the flap 101 can only be in contact with the follower member 120 at the level of the profile 121, for one single line of contact. In other words, the profile 123 provides clearance for the flap 101 to pivot when contact is made with the profile 121.

The flap actuator 102 comprises an electric motor, advantageously fixed to the chassis 104. Here, the actuator 102 is fixed to one of the two brackets. Preferably, the flap actuator 102 presents an axis of rotation that is parallel to the axis X101. In addition to the electric motor, the actuator 102 advantageously comprises a reduction mechanism 108, here comprising a gear wheel carried at the output of the electric motor, and a pinion, meshing with the gear wheel and carried by the flap 101, coaxially with the axis X101. Rotation of the motor of the flap actuator 102 then drives the flap 101 in rotation about the axis X101 relative to the chassis 104, between the release position and the working positions.

Optionally, it is provided that the adjustment device comprises a locking means, as shown in FIGS. 6 and 7. For example, the chassis 104, in particular the bracket carrying the reduction mechanism 108, includes a through-opening 109, to receive a pin parallel to the axis X101, the pin then being received in a radial recess of the gear of the reduction mechanism 108, visible in FIGS. 6 and 7. This locking means allows the flap 101 to be locked in a desired position. Thus, the flap 101 is held in position against forces applied by the heald frames 11, in case of leveling of the heald frames 11, in case of an emergency stop, or during installation of the loom, in order to secure a position of the heald frames 11. Preferably, the pin is operated by a motor.

For each shedding machine 2, when the locking system 80 locks the pivoting of the base 31 to the reference orientation, the movement of the flap 101 causes the eccentric center distance R1 to vary, in the case where the adjustment system is in amplitude adjustment configuration. Indeed, the base 31 being immobilized, the movement of the connecting rod 60 by the flap 101 via the member 120 causes a variation of the center distance R1 by radial translation of the linkage 32 relative to the base, which is the only degree of freedom then available. The flap 101 is configured to be able to vary the center distance R1 over its entire adjustment stroke, by causing the connecting rod 60 to travel a movement stroke to obtain an adjustment value corresponding to a desired shed amplitude.

For each shedding machine 2, when the locking system 80 locks the pivoting of the base 31 at the reference orientation, the movement of the flap 101 causes the eccentric center distance R2 to vary, in the case where the adjustment system is in the height adjustment configuration. Indeed, the base 31 being immobilized, the movement of the connecting rod 60 by the flap 101 via the member 120 causes a variation of the center distance R2 by relative translation of the ends 41 and 42 of the connecting rod 40, the only degree of freedom then available. The flap 101 is configured to be able to vary the distance R2 between centers over its entire adjustment stroke, by causing the connecting rod 60 to travel a movement stroke to obtain an adjustment value corresponding to a desired shed height.

Thus, the shedding adjustment can be performed by means of the device 100, in particular the flap 101, whether the actuator 102 is controlled by an automatic adjustment program, or by a person. Each actuator 20 is preferably a servomotor, or any other type of electric motor that allows for controlling the orientation of the rotor about the axis X20. In particular, each actuator 20 comprises an encoder and/or a sensor system, the measurement of which makes it possible to determine the orientation of the output shaft 28, and therefore implicitly by conversion, the position of the base 31 of the eccentric system 30, about the axis X20, relative to the frame 12, by knowing the geometry of the system. Each actuator 20 advantageously comprises output plugs, connectable to a network 22 of the loom 1, such as a measurement bus, to transmit said measurements.

As an alternative to the adjustment device 100, the machine 2 comprises an adjustment system 1100, shown in FIGS. 17 to 20. As the device 100, the purpose of the device 1100 is to carry out the adjustment of the shedding machine 2, in the case where the machine 2 is in height adjustment configuration and in the case where the machine 2 is in amplitude adjustment configuration, and while the locking system 80 is in locked configuration. For this, the adjustment device 1100 is able to actuate the respective connecting rods 60 of the machines 2 when in adjustment configuration, via the respective follower member 120.

It is also advantageously provided that a single adjustment device 1100, is shared between the machines 2.

The adjustment device 1100 comprises primarily, a flap 1101, replacing the flap 101, to move the connecting rods 60 via the respective follower member 120, as well as a flap actuator 1102, partially represented, to actuate the flap 1101.

The adjustment device 1100 advantageously comprises a chassis 1104, replacing the chassis 104. The adjustment device 1100 is positioned close to the connecting rods 60, for example above the connecting rods 60, as shown in FIGS. 17 to 20.

The chassis 1104 is a part fixed relative to the frame 12, by being integral with the loom frame. The chassis 1104 supports the flap 1101 and the actuator 1102. The chassis 1104 here also comprises two brackets, each formed from folded metal Each of the brackets is connected to a respective fixed crossbeam, belonging to the loom, not represented. The brackets are arranged either side of the connecting rod 40 assembly, parallel to the axis X20.

The flap 1101 is similar to flap 101, except for a few differences discussed later. The flap 1101 is supported by the chassis 1104, by being pivotable relative to the chassis 1104 about the axis X1101, so-called "control", advantageously parallel to the axes X20 and the axis of the flap 1102 actuator. In practice, the flap 1101 is supported by the brackets on the chassis 1104, between said brackets. The brackets support the pivoting of flap 1101 about the axis X1101 via the ends of the flap 1100. To this end, each bracket carries a respective bearing centered on the axis X1101 to support one of the ends of flap 1101. By pivoting, the flap 1101 can move one or several connecting rods 60 by driving the follower member 120, in a similar manner to flap 101, to adjust the distance R1 or R2, depending on the configuration of the actual adjustment. As with the flap 101, by pivoting about the axis X1101, the flap 1101 is moveable between a release position, shown in FIG. 20, where the flap 1101 is at a distance from the follower members 120, and the working positions, shown in FIG. 17,18 or 19, in which the flap 1101 is pressed against at least one of the follower members 120 to carry out the adjustment.

Figure 18:
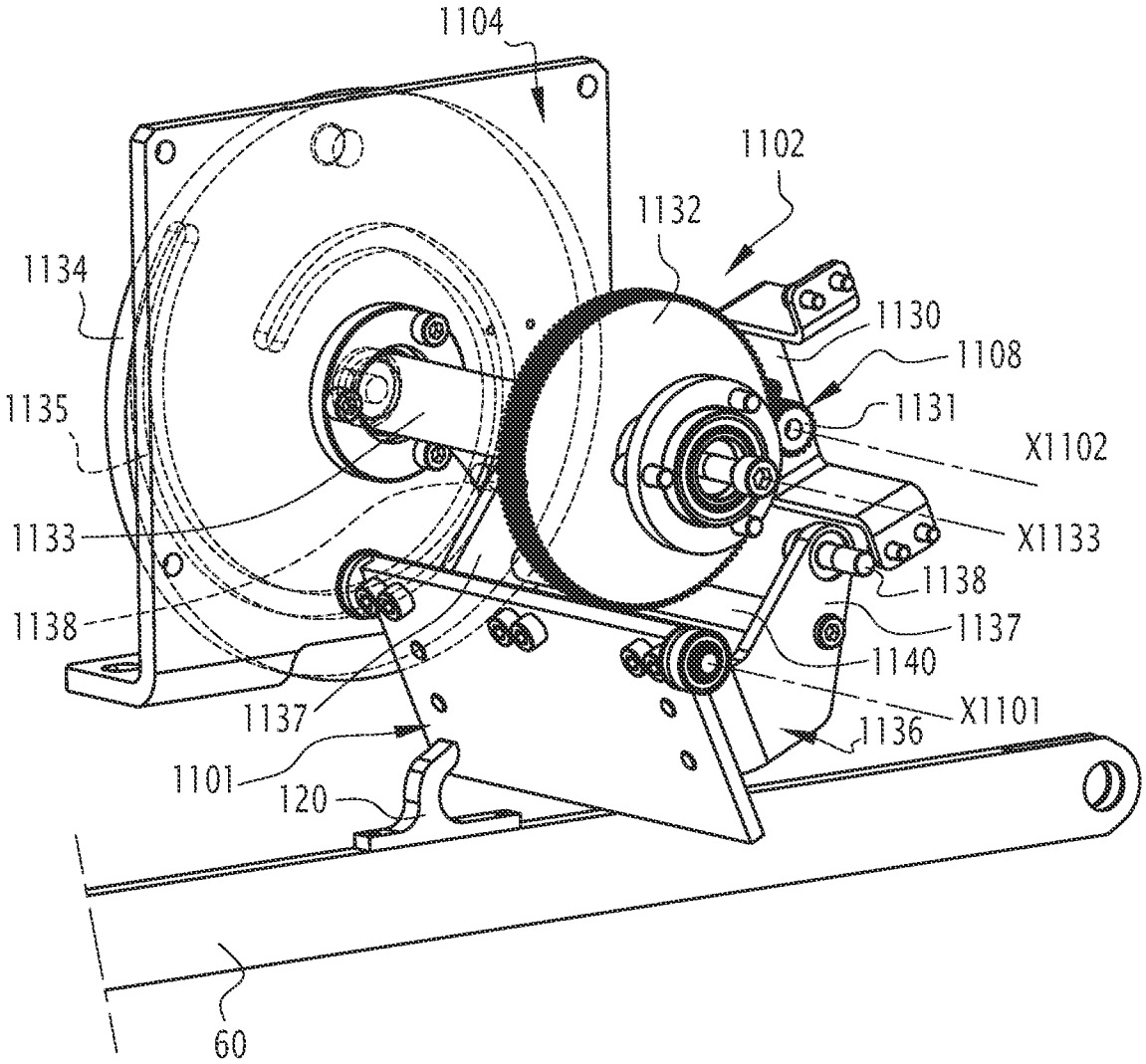
FIG. 18 is a partial view of the adjustment device of FIG. 17 in the adjustment configuration where a flap is in a working position corresponding to a minimum setting, and where a bracket belonging to the chassis and a control disc has been omitted.
Figure 19:
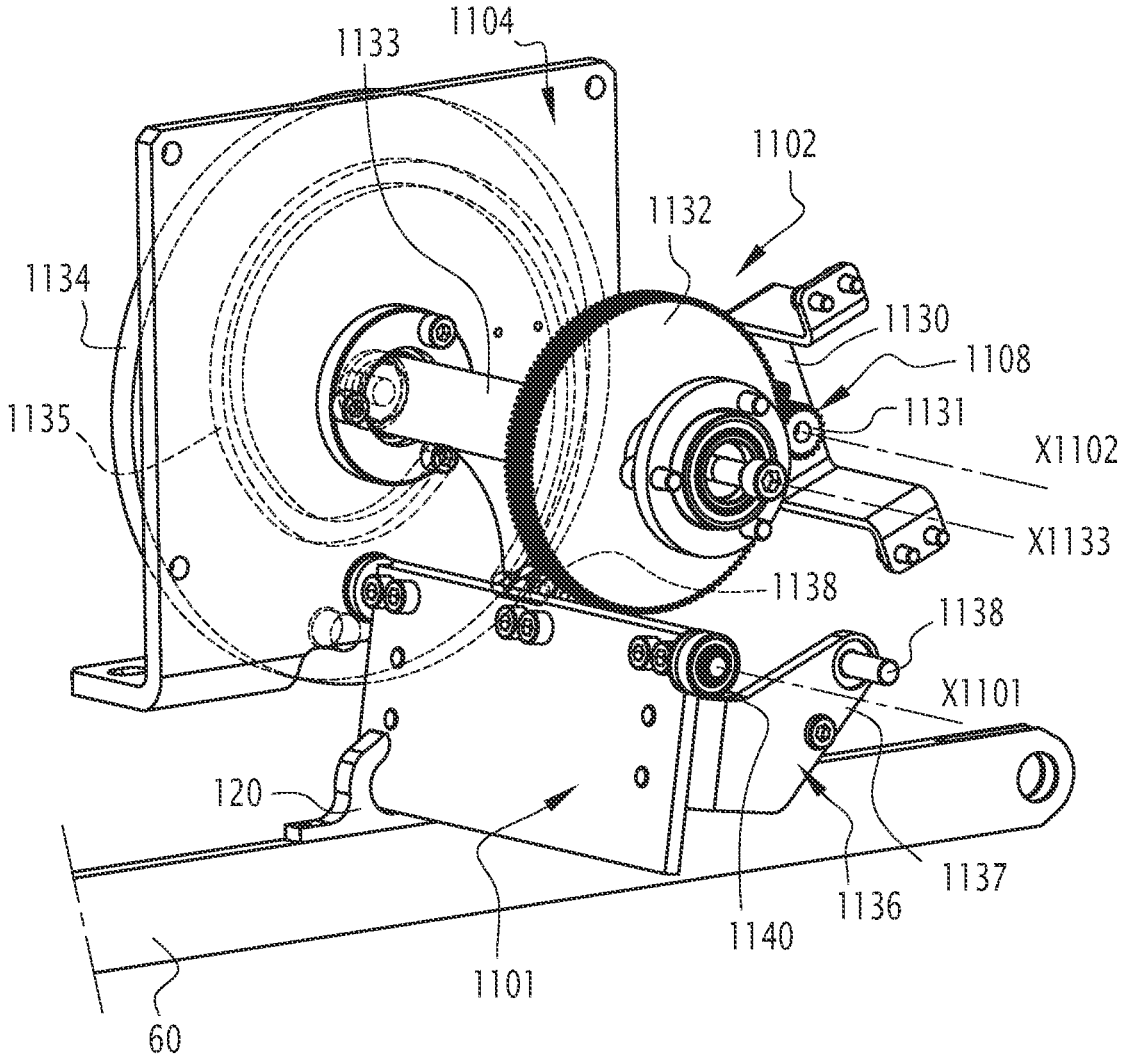
FIG. 19 is a view similar to FIG. 18, where the adjustment device is in the adjustment configuration, where the flap is in a working position corresponding to a maximum setting.
Figure 20:
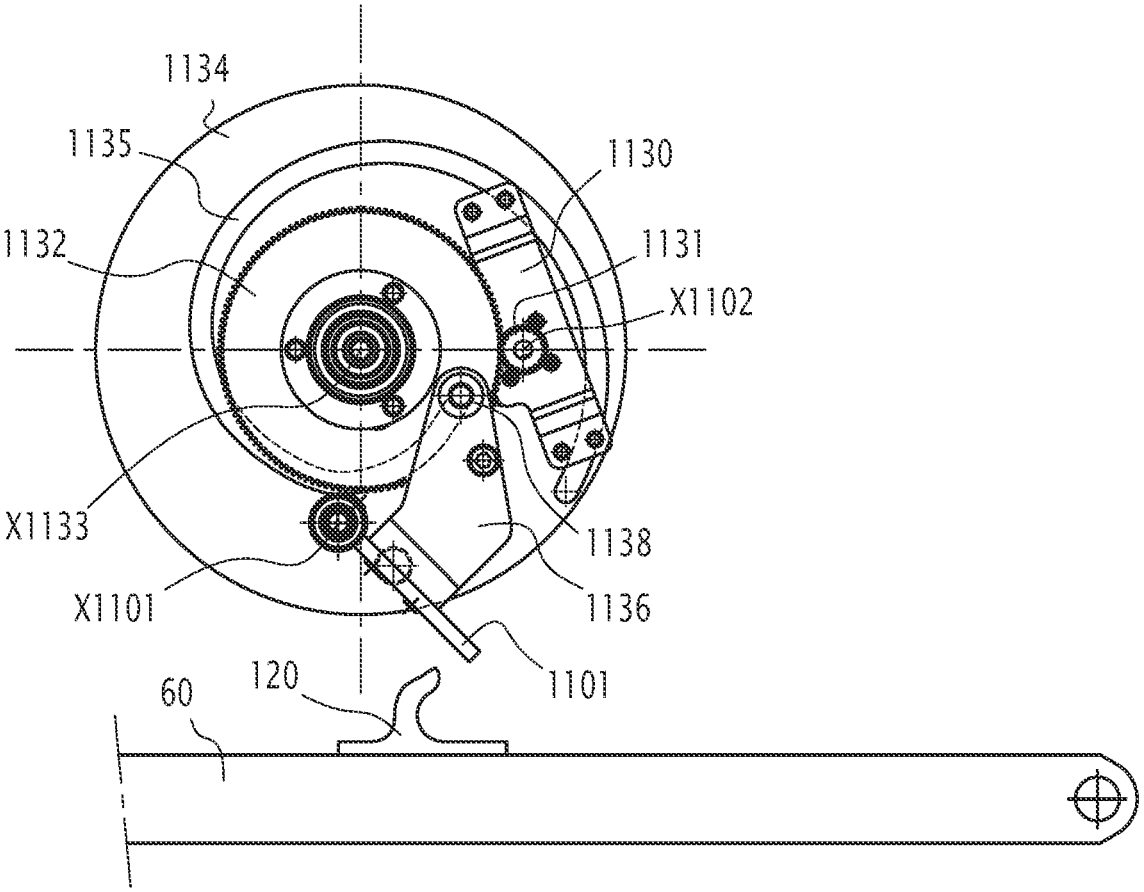
FIG. 20 is a simplified view of the front of the adjustment system of FIG. 17 where the flap is in a release position/of weaving.

The flap actuator 1102 comprises an electric motor similar to that of the actuator 102. Because the electric motor of the actuator 1102 is similar to that of the actuator 102, the electric motor of the actuator 1102 is not represented in FIGS. 17 to 20. Only one axis of rotation X1102 of the electric motor is shown in FIGS. 18 to 20. The electric motor of the actuator 1102 is fixed to the chassis 1104, for example, by means of a support 1130, in U shape, belonging to the chassis 1104, itself fixed to one of the two brackets. Preferably, the axis of rotation X1102 is parallel to axis X1101.

In addition to the electric motor, the actuator 1102 advantageously comprises a reduction gear mechanism 1108, here comprising a gearwheel 1131 carried by an output shaft of the electric motor, coaxial with the axis X1102, and a toothed wheel 1132 meshing with the gearwheel 1131. The toothed wheel 1132, pivoting about the axis X1133 parallel to X1102 and X1101 is carried by a control shaft 1133 coaxial with the axis X1133, by being fixed in rotation to the shaft 1133, for example by pinching. The shaft 1133 is supported by the two brackets of the chassis 1104, for example via thrust bearings, so as to be able to pivot, with the wheel 1132, about the axis X1133, relative to the chassis 1104.

Figure 17:
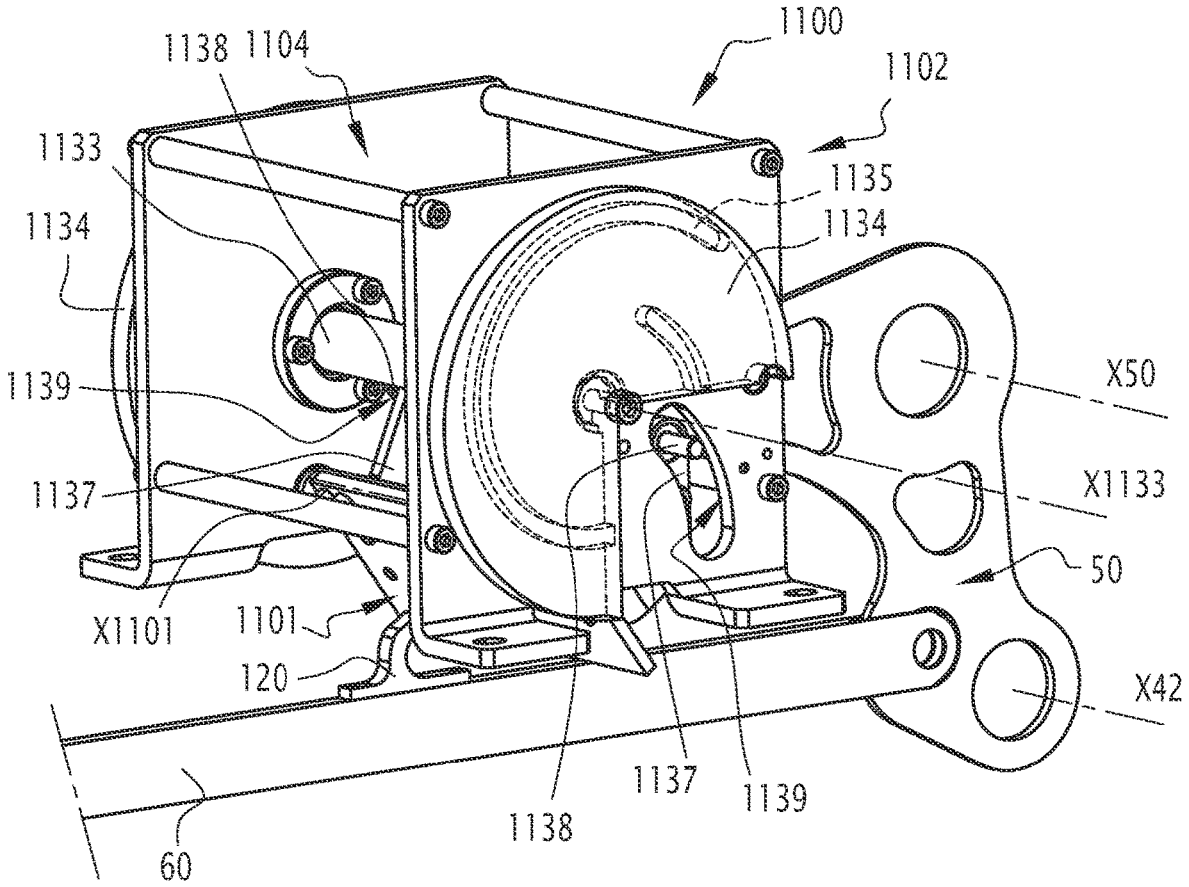
FIG. 17 is a perspective view of an adjustment device according to another embodiment of the invention where a lower quarter of a control disc of the adjustment device has been omitted.

As shown in FIG. 17, the reduction gear mechanism includes at least one, and preferably two control discs 1134, each one carried at one of the opposite ends of the control shaft 1133, being integral in rotation with the shaft 1133. The control shaft 1133 is advantageously solidly fixed at each end by a screw respective to the first and second control discs 1134 which extend outside the chassis 104, respectively along each bracket. Each bracket of the chassis is arranged between one of the discs 1134 and the toothed wheel 1132.

Each control disc 1134 defines a helicoidal groove 1135 which extends over about 360° turned toward the inside of the chassis 1104, between a first end, close to the center of the disc 1135, and a second end on a maximum radius of the disc 1134. The first and second ends of the helicoidal groove 1135 being close to being aligned with the center of the disc 1134. The discs 1135 are indexed about a control shaft 1133 so that the grooves are aligned with each other parallel and around the axis X1133.

The flap 1101 carries a hoop 1136 which comprises two arms 1137 which extend perpendicular to the axis X1101, and which are arranged between the two brackets of the chassis 1104. At their respective ends, the arms 1137 carry a respective pin 1138, parallel to the axis X1101 and belonging to the reduction gear mechanism 1108. Each pin 1138 extends through one of the chassis 1104 brackets, through one of the through grooves 1139 of the bracket under consideration, toward the outside of the chassis 104. The through groove 1139 presents a kidney shape, in other words, the arc of a circle, centered on the axis X1101, which corresponds to the circular trajectory of the pin 1138, about the axis X1101 of the flap 1101. The pin moves along the groove from one end to the other, during the rotation of the flap 1101. Preferably, the arms 1137 are held apart, relative to each other by a reinforcing bar 1140, part of the hoop 1136, for example, fixed by a respective screw on each of the arms 1137.

Each pin 1138 is received in one of the grooves 1135 in order to be guided by the groove 1135 of one of the control discs 1134. The movement of the flap 1101 is controlled by the rotation of the motor in a first or second direction, which drives a corresponding rotation of the flap 1101 via means of the reduction gear 1108, in particular with rotation of the gear wheel 1131, driving the wheel 1132 in rotation, and driving the control shaft 1133 in rotation, leading to the rotation of the control discs 1134 which drive the movement of each pin 1138 in the helicoidal groove 1135. As shown in FIGS. 17 to 20, the geometric definition of the helicoidal groove 1135, changes the rotation of the electric motor in a first direction into the movement of the pin 1138 toward the center of the disc 1134, which leads to the release of the flap 1101 either to reduce the shed, or toward the release position of the flap 1101 which no longer interferes with the follower member 120, in particular so as not to interfere with the weaving. Rotation of the electric motor in the second direction, opposite the first direction, controls the movement of the pin 1138 toward the outside of the disc 1134, which leads the flap 1101 to pivot in the opposite direction, toward an increase of the shed. For the first direction as for the second direction, the pins 1138 press against an internal track of the groove 1135, so that the forces generated by the weight of the heald frame 11 via the intermediary of the flap 1101 are directed radially toward the center of the control shaft 1133. Thus, the weight of the heald frames 11 is therefore taken up by the connection between the pin 1138 and the groove 1135 and not by the electric motor. This presents the advantage in the size of the electric motor of the actuator 1102, which can be reduced, because the torque generated by the electric motor does not need to support, or hold, the weight of the heald frames 11.

FIGS. 18 and 19 represent two different shed settings in which the flap 1101, in working position has been moved, between two respective angular positions of the control discs 1134 under the action of the electric motor of the actuator 1102. FIG. 20 represents the flap 1101 in the release position where the pins 1138 reach the bottom of the groove 1135 of the control disc 1134.

The adjustment device 1100 presents the advantage of being particularly robust and the forces in the mechanical articulations of the adjustment device 1100 are reduced. Advantageously, the system prevents the heald frame 11 from falling when the adjustment device 1100 is in the adjustment configuration. Advantageously, the reduction offered by the complete mechanism allows to multiply the support forces of the electric motor, which requires a low torque to drive the flap 1101 and the heald frame 11 associated with the shedding adjustment. Advantageously, the planned motor size may be small and of low power.

Alternatively, other geometric definitions can be employed to move the flap or other reduction mechanisms can be used.

The shedding machine 2 advantageously comprises one or more actuator microcontrollers 23 for driving the actuator 20 by controlling the power circuit 21 distributing electrical energy to this actuator 20, taking into account said measurement of the orientation of the output shaft 28, retrieved via the network 22.

Advantageously, the loom 1 comprises a master controller 24, which exchanges data with the actuator microcontroller(s) 23. The master controller 24 can execute a weaving program to control the weave of the loom, controlling the actuators 20, and other programs, such as an adjustment program, a calibration program, etc. For the control, the microcontroller 23 and/or the master controller 24 take into account a library, which includes certain data, in particular remarkable preregistered actuator positions, entered at the terminal, or entered by calibration procedure. Advantageously, the controller has memories for the data libraries. A memory is adapted to store a current actuator position data or data relative to predetermined positions to be reached. For example, a memory may store the position of the rotary actuator corresponding to the stop position on a stop during amplitude adjustment. The controller can call up its memories and position data at any time to perform control steps. The controller is associated with a computer and a comparator in the actuator servo system which allow to quantify the movements necessary to reach predetermined positions. In particular, the controller, knowing the current position of the actuator, calculates the predetermined angle corresponding to the predictable rotation according to the position of a stop to be reached. The memories are configured to capture, retain or return this data to the controller.

The actuator motor 102 is preferably a servomotor and comprises an encoder and/or sensor, the measurement of which determines the orientation of an output shaft of the motor. By converting this information, the machine knows the position of the flap 101, and can deduce the adjustment made, when a follower member 120 is driven. By knowing the geometry of the system, in particular the flap 101, the reduction mechanism 108, the geometry of the follower members 120, the distance between the axis X101 and the line of contact between the flap 101 and the follower member 120, and the shedding adjustments previously made, the machine is able to determine the positions to be reached during the shedding amplitude or height adjustment. Advantageously, the loom 1 comprises a flap microcontroller 103 for controlling the actuator 102. For example, the microcontroller 103 performs this control by controlling a power circuit distributing electrical energy to the actuator 102, taking into account said output shaft orientation measurement, retrieved via the network. The master controller 24 exchanges data with the microcontroller 103.

The loom 1 preferably comprises a terminal 25 to allow a person to control and/or parameterize the operation of the loom 1 via the master controller 24. For example, the terminal 25 offers the person to start a specific step of an adjustment procedure, to validate that a manual step has been performed and/or to enter parameters. The terminal 25 is used to display information about the progress of the procedure and to indicate warning signals to the user.

A shedding assembly is defined as a subset of the loom 1, including the shedding machines 2, the setting device 100 and the members 120.

Figure 12:
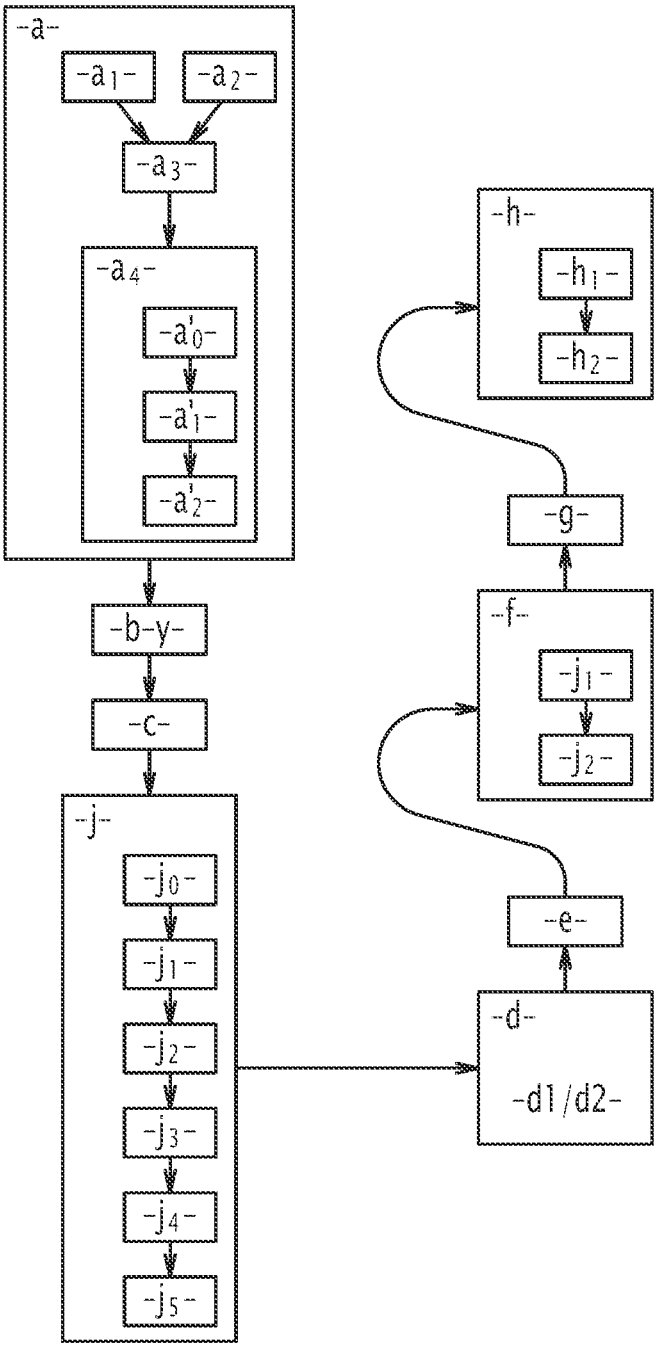
FIG. 12 is a block diagram of an adjustment method in accordance with the invention.

The loom 1, and more particularly each shedding machine 2, allows for the implementation of an adjustment method defined below and illustrated in FIG. 12.

The different geometries of the pulling mechanism belonging to the machines 2 of the loom 1 lead to the actuation of the flap 101 in different angular ranges from one connecting rod 60 to another and/or from one loom to another, to perform the same adjustment. When the loom 1 has been assembled for the first time, or during a maintenance or calibration operation, particular working positions of the flap 101, constituting reference positions of the flap 101, are advantageously recorded in a data library, belonging, for example, to the controller 24, memorizing which shed settings these reference positions correspond to. Thus, amplitude adjustment and/or height adjustment reference positions and the maximum and minimum stop reference positions, are entered into the data library. In practice, the position of the output shaft or rotor of the actuator 102, the position of which is captured, and which corresponds to the position of the flap 101, is recorded. The position of the flap 101 is associated with the position of the member 120 when the heald frame 11 is in position H11, in other words the reference positions of the flap 101 correspond to the configurations when the frame is set in the high position H11.

For example, for each machine 2, the working positions of the flap 101 are recorded as reference positions, corresponding to the case where the distances R1 and R2 are minimum, the case where the distances R1 and R2 are maximum, the case where the distance R1 is minimum while the distance R2 is minimum and vice versa, and the case where the distances R1 and R2 are at a particular intermediate value. For example, the working positions of the flap 101 corresponding to the case where the heald frame 11 is positioned at positions B11, H11 and P11, when the locking system is in the locked configuration and for a known height and amplitude setting, are recorded. Advantageously, the working positions of the flap are recorded in the case where the heald frame 11 is in position H11 and for a known height and amplitude setting. Other reference positions corresponding to particular amplitude and shed height adjustment configurations are also stored, which the machine or operator can call upon to set the adjustment system. Similarly, notable angular positions are stored for each adjustment configuration, corresponding to different cases where the ends 41 and 42 are abutting relative to each other, and the linkage 32 is abutting relative to the base 31. Many configurations are possible, in that, depending on the height adjustment, the adjustment position of the flap 101 to reach the amplitude adjustment stops changes, and vice versa. This data is stored in the data library, physically in memories in the controller 24.

Knowing these remarkable angular positions in advance allows later detection of possible faults during the adjustment method or during weaving, in particular if the working position at which the flap 101 brings the pulling mechanism to a stop does not correspond to the reference position expected in the context considered.

The following relates to the actual adjustment method. During the entire adjustment method, a reduction in the tension of the warp threads supported by the heald frames 11 is advantageously provided for, in order to reduce the forces applied by the heald frames 11 to the machines 2. In order to start the adjustment method, it can be provided that a person indicates to the loom 1 to start the adjustment method via the terminal 25. Also, it is provided to reduce the tension of the warp yarn layers on the loom.

The actual adjustment method first comprises a step a of selecting the machine 2 or machines 2, to be adjusted. This step a comprises a step a1 of pivoting the base 31 of the machine 2 that is to be adjusted, or the machines 2 that are to be adjusted, to the reference orientation. This step a also preferably comprises a step a2 of pivoting the base 31 of the other machines 2, which it is not desired to adjust, to the release orientation. The step a2 is preferably performed before step a1.

Thanks to the step a2, the follower members 120 of the machines 2 that are not to be adjusted are moved to a release position, so that they are not driven by the flap 101 even when the flap 101 is in the working position. The movement of these follower members 120 to the release position is advantageously obtained by movement of the relevant connecting rods 60 under the action of the rotary electric actuators 20 of the machines 2 which it is not desired to adjust. The release position of the follower members corresponds, for example, to the low position B11 of the corresponding frames 11 along their stroke C11. Advantageously in this configuration, the locking means of the machines 2 concerned, in particular the screws 98, are not accessible to the technician, who therefore has no possibility of accidentally putting the machines 2 concerned into an unlocked configuration.

Thanks to the step a1, the follower member 120 of the machine 2 that is to be adjusted is moved to a docking position, in which the flap 101 is able to drive the follower member 120 of this machine 2. The movement of the follower member 120 to the docking position is therefore advantageously obtained by movement of the connecting rod 60 which carries it under the action of the rotary electric actuator 20 of the machine 2 to be adjusted. The docking position of the follower member 120 corresponds, for example, to the high position H11 of the heald frame 11 along the stroke C11. Advantageously, in this configuration, the locking means of the machine 2 to be adjusted, in particular the screws 98, are accessible to the technician, who will therefore be able to easily put the machine 2 to be adjusted in an unlocked configuration, at a later step.

Once step a1 has been carried out, a step a3 is carried out to lock the base 31 of the machine 2 to be adjusted, in the reference orientation. For this purpose, a locking configuration of the locking system 80 is performed. Preferably, the terminal 25 prompts the technician to perform this action. In practice, the technician moves the pin 81 of the machine 2 to be adjusted into the locking position, as shown in FIGS. 8 and 9. Preferably, for the other machines 2, it is not possible to accidentally put the locking system 80 into the locking configuration, since the pins 81 are mechanically prevented from being put into the locking position. Indeed, for each of these machines the base 31 of which is previously oriented in the release orientation, the notch 85 is not aligned with the pin 81. Since the heald frame 11 is in the low position B11 when the base 31 is in the release orientation, and the tension of the warp threads has advantageously been released, the heald frame 11 tends to maintain the pulling system in this position, under the effect of gravity. Therefore, it is advantageously not necessary to provide a locking of the base 31 of the machines 2 that are not adjusted and have been put in the release orientation, even if the power supply to their actuators 20 is cut off.

Alternatively, it is provided that the technician proceeds to a preliminary step of putting the pin in the locking position, by means of the shutter 187 shown in FIGS. 21 to 24.

On operating the actuator 20, the shutter is in the nominal position shown in FIG. 21. When the shutter 187 is turned by the technician in either a clockwise or anticlockwise direction of about 40° in the first tipping position, for example, that shown in FIG. 22, the indexing finger 181 is released from the lobe 190 so that the technician is able to access the indexing finger to carry out the locking step a3. To do this, the technician presses, for example, on the finger 181 left free by the shutter 187 to pass this into the locking position, as shown in FIG. 23.

After having pressed the indexing finger 181 down during the locking step a3, the shutter is free to turn more so that the technician covers the indexing finger 181 with the lobe 189 of the shutter 187, in a second tipping position shown in FIG. 24.

The shutter 187 being advantageously in metal, and the lobe 189 forming a greater mass than the lobe 190, the shutter 187 naturally finds the angular nominal position of FIG. 21, by gravity, in which the lower lobe 189 centers itself in the lower portion so that the upper lobe 190 finds a position covering the indexing finger 181, and the lower lobe 189 finds a position covering the head of the locking screw 93. In particular, the lobe 189 covering an opening 192 arranged through the wall 86 and/or the housing 188, giving access to the locking screw head 93. Access to the locking screw and access to the indexing finger are therefore prevented in the nominal angular position. The shedding adjustment sequence is therefore secured.

The shutter 187 is easily manufactured by cutting, folding and machining operations of a hole for the axle.

Machining this shutter 187 can be generalized to all the actuators 20 which are equipped with this shutter 187.

The use of such a shutter 187 minimizes the risk of accidentally actuating the locking device 180, to avoid for example, an accidental pinning of the actuator 20 when working, reducing the risk of tightening error in the adjustment sequence, and improving the general security of the machine 2. In particular, the use of the shutter 187 avoids accidental maladjustment of the screw 93 in a situation where the finger 181 has not previously been put into a locking position.

After step a3 and before step b, the method advantageously comprises a locking check step a4, to verify that the locking system 80 of the machine 2 to be adjusted has been properly put in the locking configuration. Step a4 is performed while the flap 101 is in the release position so as not to interfere with a possible movement of the follower member 120. This step a4 is performed at reduced torque for the actuator 20, to avoid breakage of the locking system 80 and/or the actuator 20.

The step a4 comprises a step a'0 of controlling the actuator 20 to rotate, a step a'1 of verifying that the rotary electric actuator 20 has not rotated despite the control to rotate, to verify that the locking system 80 is properly in the locking configuration. The step a4 then comprises a step a'2 of issuing an alarm, in the event that it has been determined that the actuator 20 has rotated, reflecting that the locking system 80 is not in a locking configuration. Otherwise, the method continues.

After step a, the method advantageously comprises a step b of moving the flap 101 to the working position, under the action of the actuator 102. The working position is reached when the flap 101 docks with the follower member 120 of the machine 2 to be adjusted, this follower member 120 being in the docking position. The flap 101 just comes into contact with the follower member 120 in the docking position but does not yet take up the forces applied to the connecting rod 60 from the heald frame 11, since the adjustment system of the machine 2 to be adjusted is still in locked configuration. It is provided advantageously to carry out step b before putting the machine into the adjustment configuration, to avoid spontaneous maladjustment under the effect of the forces applied by the heald frame 11.

Preferably, it is known in advance that the working position to be reached by the flap 101 for docking with the member 120 should be the same as the working position at which the flap 101 was positioned during a previous execution of the adjustment method for this machine 2.

Moreover, during step b, the members 120 equipping the other machines 2 are not docked by the flap 101, since they are in the release position.

The method comprises a step y of controlling the motor torque of the flap actuator 102 during step b. In other words, the actuator 102 is operated at reduced torque to perform step b, which avoids a risk of breakage. Also, this step allows to verify that the contact of the member 120 with the flap 101 is properly established at the expected working position, so that if the actuator is limited before the expected position, or is not stopped at the expected position, the controller is able to detect a likely maladjustment or loosening during weaving.

Once step b has been performed, the method comprises a step c of setting the adjustment configuration of the adjustment system 2 of the machine that is to be adjusted. The step c of setting the adjustment configuration is performed manually by the technician. The technician chooses whether to set the adjustment system to the amplitude adjustment configuration or the height adjustment configuration.

In the present example, the person loosens either the screw 93 without loosening screws 98, to move into the amplitude adjustment configuration, or screws 98 without loosening screw 93, to move into the height adjustment configuration. Once in the adjustment configuration, the flap 101 takes up any forces applied by the heald frame 11, thus avoiding an unintended adjustment.

Preferably, the adjustment method comprises cutting off a power supply to all rotating electric actuators 20 during the step c of moving to the adjustment configuration, for safety reasons. Without a power supply, the actuators 20 cannot be activated, neither automatically by the controller 24 nor by control from a person. In other words, throughout step c, the actuators 20 are prevented from being set in motion automatically for safety reasons, while the technician manually operates the adjustment configuration.

After step c, the method comprises an adjustment step d, which may be in the form of a distance R1 adjustment step d1, or a distance R2 adjustment step d2, depending on the current adjustment configuration determined in step b.

Preferably, after step c and before step d, that is, before step d1 or d2, the method comprises a prior control step j. The purpose of step j is to check that the desired setting configuration has been duly achieved, that is, that the correct screws have been loosened, and that they have indeed been loosened. This step j includes a step j0 of transmitting an instruction to rotate the flap actuator 102, in other words, to control the rotation of the actuator 102. This command to rotate controls the rotation of the actuator 102 in a first direction, for example a direct direction. In practice, the actuator 102 executes the instruction until one of the stops is reached, to serve as a reference. At this point, a step j1 is provided to measure the angle of rotation that has been described by the flap actuator 102 or by the flap 101 that has executed this instruction. Depending on the situation, this stop corresponds to one of the minimum or maximum values of center distance, of the connecting rod R2 or eccentric R1. A step j'1 is then provided for comparing the measured angle of rotation with a predetermined angle corresponding to the predicted rotation based on the position of the stop, in order to establish whether the shedding machine 2 is in a nominal situation or in a faulty situation, such as a loosening fault or an adjustment fault.

This prior check then includes a step j2 of transmitting an instruction to drive in rotation the actuator 102 in the reverse direction. In other words, the actuator 102 is driven in rotation. In practice, the actuator 102 executes the instruction until it reaches another stop. This other stop corresponds to the other minimum or maximum value of center distance, of the connecting rod R2 or eccentric R1. These instructions are transmitted while the actuator 102 is locked below the adjustment torque value, to avoid any risk of breakage if the stop is not met for the expected angular position, and also to be able to detect the resistance of the stop. The prior control includes a step j3 of measuring the angle of rotation described by the actuator 102, following the execution of the rotation instruction, where the actuator 102 is expected to have driven the pulling mechanism from the first stop to the second stop via the member 120. The prior control includes a step j4 of comparing the measured angle with a target value that has been prerecorded in the library, to establish whether the machine 2 is in a nominal situation, or in a faulty situation, such as a loosening fault or an adjustment fault. In other words, the measured angle is compared with a predetermined angle corresponding to the rotation to be expected after the position of the adjustment stop.

For example, if the measured angle is zero or very small, it is identified that the adjustment system has remained in a locked configuration. This is a loosening fault. For example, if the measured angle matches that of an amplitude adjustment range, while a height adjustment configuration was desired, it is identified that the adjustment system was mistakenly put in the amplitude adjustment configuration. This is another loosening fault. For example, if the measured angle matches that of a height adjustment range, while a range adjustment setting was desired, it is identified that the adjustment system was set to a height adjustment setting by mistake. This is another loosening fault. For example, if the measured angle is the sum of the height adjustment and amplitude adjustment ranges, it is identified that the adjustment system has been put into a configuration where the two distances R1 and R2 are variable, by loosening all the locking means of the adjustment system. This is another loosening fault. For example, if the measured angle of rotation does not correspond at all to an angle corresponding to the above situations, this may be an adjustment fault, indicating that a previously performed adjustment procedure was carried out incorrectly or that the adjustment system went out of adjustment during weaving.

When a fault is detected, a step j5 of issuing an alarm, preferably to the person, for example via the terminal 25, is provided to indicate to the person that a fault has occurred, and the type of fault identified. The adjustment method is interrupted so that corrective action can be taken, in particular, performing the step c of setting the adjustment configuration correctly. Otherwise, the method goes directly to the adjustment step d1 or d2.

Alternatively, the prior control step j can be performed by controlling the attainment of a single stop from an expected angular movement range to the first stop.

Preferably in the case of a shed amplitude adjustment, a drive instruction is transmitted to the actuator 102 corresponding to a stroke from the minimum shed amplitude adjustment value to reach the desired high adjustment value, so that the flap moves the follower member against the direction of the forces of gravity. Preferably, in the case of shed height adjustment, a drive instruction is transmitted to the actuator 102 corresponding to a stroke from the minimum shed height adjustment value, to reach the desired high adjustment value, so that the flap moves the follower member against the direction of the forces of gravity.

In the case where the step c has put the adjustment system in the amplitude adjustment configuration, step d1 of adjusting the eccentric center distance R1 is performed. The step d1 is performed by driving the follower member 120 by means of the flap 101, which in turn is driven by the actuator 102. The flap 101 performs the adjustment by moving the connecting rod 60 via the member 120. In the case where step c has put the adjustment system in the height adjustment configuration, the step d2 of adjusting the connecting rod center distance R2 is performed. The step d2 is performed by driving the follower member 120 by means of the flap 101, which is itself actuated by the actuator 102. The flap 101 performs the adjustment by moving the connecting rod 60 via the member 120.

Providing that the base 31 is locked at the reference orientation by the locking system 80 makes it possible to carry out the step d1 of amplitude adjustment or the step d2 of height adjustment by actuating the actuator 102. In order to perform the adjustment, it can be provided that the actuator 102 is actuated upon command from the person, for example via the terminal 25. For example, provision can be made for the person to instruct the actuator 102, via the terminal 25, to increase the rotation of the actuator 102 until the desired setting for the amplitude or height of the stroke C11 is reached. Alternatively, it may be provided that the person instructs the actuator 102 to position the flap 101 directly at an angular target value, in order to achieve the desired setting. The actuator 102 is controlled in rotation according to a target value or incremental value relative to a desired frame stroke amplitude or frame stroke height. In other words, the control in rotation of the actuator 102 comprises transmitting a target value or incremental value instruction to the actuator 102 relating to an increase or a decrease of an adjustment among the eccentric center distance adjustment R1 or the connecting rod center distance adjustment R2.

The actuator 102 is thus driven to the predetermined value. Alternatively, it may be provided that the person indicates directly the desired adjustment, and the actuator 102 then takes the angular position necessary to achieve that adjustment, based on the information in the library. It may also be provided that the person can verify the adjustment by the set of marks carried by the pulling mechanism. It may also be provided that the actuator 102 is operated automatically by the controller 24 to make the adjustment without the intervention of the person, possibly under the supervision of the person, with the controller 24 executing a prerecorded adjustment program. To verify whether the desired amplitude or height value is achieved, it is advantageously provided that the terminal 25 indicates, based on the angular position information supplied by the actuator 102, the current setting.

During the adjustment step, whether it is the step d1 or step d2, it can be provided that the torque of the actuator 102 motor is limited below the adjustment torque value. For verification of the adjustment by the person, it may be provided that the power supply to the actuators 20 is switched off for safety reasons. Once the adjustment is made, the angular position of the actuator 102 is stored in the library as the current adjustment for the particular machine 2. This adjustment value can be called up later, for example during a new adjustment method.

Once the height adjustment step d2 is performed, a new amplitude adjustment configuration step c may optionally be provided, followed by a new amplitude adjustment step d1. If the amplitude adjustment step d1 was performed first, a new height adjustment configuration step c may be provided, followed by a new height adjustment step d2. As seen previously, the new adjustment configuration step c may be followed by a control step prior to the adjustment step. Since step c requires manual intervention, as seen previously, it can be provided to cut the power supply to the actuators 20.

It is noted that, during steps b, c and d, while the locking system 80 is in the locking configuration and the base 31 is in the reference orientation, the connecting rod 40 of the machine 2 to be adjusted is parallel to the translation axis R32, which facilitates the calculations and constitutes an optimal position for the adjustment of the distances R1 and R2 by the flap 101. Moreover, during the driving of the follower member 120 by means of the flap 101, in particular in step d, the flap 101 is continuously held pressed against the follower member 120 in the retaining direction d101, against the forces applied by the heald frame 11 tending to move the connecting rod 60 in the opposite direction to the retaining direction d101.

Thanks to the invention, the result of the shed amplitude and/or shed height adjustment method, allows the technician to observe the adjustment visually, at the level of the frame and the warp threads, since the frame is driven by the flap actuator between two adjustment changes, in the adjustment configuration.

Thanks to the invention, the means implemented for the adjustment of the shedding machines of the loom are mutualized and allow a precise adjustment based on a single controller 103 and actuator 102. The adjustment is thus made more reliable.

As an alternative to using the device 100, the adjustment step d1 and/or d2 can be carried out in conformity with the invention by the adjustment device 1100 illustrated in FIGS. 17 to 20.

Once the adjustment step d1 and/or d2 is completed, a step e of putting the adjustment system into a locked configuration is implemented. This step is carried out manually by the user, who locks the locking means, in this case by tightening the screws 93 or 98 which had been loosened during step c. For safety reasons, it is advantageously provided that the power supply to the actuators 20 is cut off during this step. During this step e, the locking system 80 is still in a locking configuration to keep the base 31 immobile. Once this step e is complete, the distances R1 and R2 are fixed, since the ends 41 and 42 are joined and because the linkage 32 is integral with the base 31.

Preferably, once the step e of putting in the locked configuration is completed, a locking control step f is implemented, in order to ensure that the machines 2 are duly in the locking configuration after the manual intervention of the person. For this locking control step f, the locking system 80 is held in the locking configuration. For this locking control step, the power supply is restored. Preferably, the torque of the actuator 102 is limited below the adjustment torque value to prevent breakage. The locking control step f comprises a step of transmitting a rotational drive command by the flap actuator 102, a measurement of the angle of rotation described by the flap 101 while the actuator 102 has executed this drive command, and a comparison of the measured angle of rotation with a target value, to establish whether the adjustment system is duly in the locked configuration, or in a locking fault situation. In other words, a verification step f1 is provided to check that the flap actuator 102 is not rotating, under the application of a predetermined torque value, the delivered motor torque being monitored during this measurement. To perform step f1, it is provided that the actuator 102 rotates in a direction that causes the flap 101 to drive the member 120 in the direction d101. In practice, to consider that the adjustment system is duly in the locked configuration, it is checked that the angle of rotation is zero or almost zero while the delivered motor torque is greater than the passive torque of the system, of the order of two times greater than the torque exerted on the actuator 102 by the weight of the frame and the transmission, insofar as, in the locking configuration and in the locked configuration, the pulling mechanism is normally fully immobilized. In this case, the adjustment method is continued. On the contrary, the locking system is considered not to be in locked configuration when the actuator 102 has traversed an angle that is not zero, or greater than a predetermined threshold. At this stage, it is known only that this is not a locking fault, since the previous steps, in particular the adjustment step, were able to be executed. If it is considered that the adjustment system is not in the locked configuration, a step f2 is provided which includes emitting an alarm, preferably to the person, for example via the terminal 25, signaling the locking fault. Then, the method is interrupted so that corrective measures can be taken. For example, the step e of putting the system into a locked configuration can be restarted, or a corrective action can be triggered via the controller if the system has electronic locking means to implement.

After steps e and f, the method comprises a step g of authorizing the pivoting of the base 31, by putting the locking system 80 into a release configuration, for the machine 2 that has just been adjusted. To do this, the technician moves the pin 81 of the machine 2 in question, to the release position. During this step, the actuator 20 is supplied with power to maintain the orientation of the base, for safety reasons. The pivoting of the base is no longer mechanically limited by the pin and can again be controlled by the actuator 20. The pivoting of the base 31 is then allowed. Alternatively, during this step g, provision may be made for the power supply to the actuators 20 to be switched off, where maintaining the alignment of the axes X42, X41 and X20 prevents the risk of the frame falling which has been adjusted during this step. According to this alternative, once the step g is executed, all actuators 20 can be powered again.

After step g, the method advantageously comprises a release control step h, in order to ensure that the machine 2 that has been adjusted is duly in the release configuration after the manual intervention by the person on the pin 81. For this release control step, the power supply is restored. Preferably, the torque of the actuator 102 is limited below the adjustment torque value to prevent breakage. The release control step comprises a step of transmitting a rotation drive command by the flap actuator 102, a measurement of the angle of rotation described by the flap 101 while the actuator 102 has executed this drive command, and a comparison of the measured rotation angle with a target value, to establish whether the locking system 80 is in the release configuration, or in a release fault situation. In other words, a control step h1 is provided to verify that the flap actuator 102 is actually turning, when a predetermined torque value is applied with the actuator 102. The delivered motor torque is monitored during this measurement. To perform step h1, it is provided that the actuator 102 turns in a direction that causes the flap 101 to drive the member 120 in the direction d101. In practice, to consider that the locking system 80 is duly in the release configuration, it is verified that the angle of rotation exceeds a predetermined value. In this case, the adjustment method is advantageously completed for this machine 2. On the contrary, it is considered that the locking system 80 is not in the release configuration when the actuator 102 has traveled a zero, or too small an angle. If it is considered that the locking system 80 is not in the release configuration, a step h2 is provided including the emitting of an alarm, preferably for the attention of the person, for example via the terminal 25, signaling the release failure. Then, the method is interrupted so that corrective measures can be taken. For example, the unlocking step g can be restarted.

Once all the steps a to h have been performed, it is optionally provided that the person confirms, via the terminal 25, that the adjustment method has been performed successfully. The adjustment method can then optionally be performed again to carry out the adjustment of another of the machines 2. A weaving operation can then be started with the new shed adjustment.

The adjustment method described above also applies, mutatis mutandis, to the other embodiments described below.

Alternatively, the adjustment method can be performed repeatedly to set the distance R1 successively for each machine, and then the adjustment method can be executed repeatedly to set the distance R2 successively for each machine, or vice versa.

Alternatively, a plurality of devices 100 are provided, each device 100 being respectively dedicated to adjusting one or more machines 2. Alternatively, a respective device 100 is provided for each machine 2.

Alternatively, the step c of setting up the adjustment configuration is automated or assisted. For this purpose, for example, the manual locking systems presented above, here the screws 93 and 98, are replaced by automatic systems, including for example motors or electromagnets.

Alternatively, the locking system 80 is automated. For this purpose, for example, the pin 81 is actuated by an actuator, such as a cylinder.

Alternatively, to actuate the flap 101, another type of actuator is provided than the one described above, such as a cylinder, or two linear actuators at each axial end of the flap 101, to actuate the flap 101 by moving the follower member in a linear manner parallel to the second connecting rods 60. In this case, it can be provided that the flap 101 is not pivoting but sliding according to a direction parallel or almost parallel to the connecting rods 60.

Alternatively, a sensor is provided that checks whether the locking system 80 is in the locking configuration or in the release configuration, for example by checking the position of the pin 81. Steps a4 and g are then modified accordingly.

Alternatively, a brake may be provided which, in the adjustment configuration of the adjustment system, brakes the heald frame 11, the connecting rod 60, the lever 50 and/or the lever 70, to prevent the frame from applying forces on the connecting rod 60 due to gravity.

Alternatively, instead of providing that the flap is pressing only in the direction d101 against the member 120, it is provided that the flap is capable of pressing also in the opposite direction, especially when the aforementioned brake is provided.

Alternatively, during step c of the adjustment method, all machines 2 are put in the amplitude or shed adjustment configuration. In the following step d1, the adjustment of all machines 2 is performed successively from the highest amplitude to the lowest amplitude. The locking step e is performed for each machine 2, as soon as this machine 2 is adjusted, and before adjusting the next machine 2. Similarly, in the following step d2, all machines 2 are adjusted successively from the highest height to the lowest height. The locking step e is performed for each machine 2, as soon as this machine 2 is adjusted, and before adjusting the next machine 2.

Alternatively, in step a, a plurality of machines 2 are selected to be adjusted at once, these machines 2 are then adjusted with the same height adjustment and/or the same amplitude adjustment.

Alternatively, the follower member 120 is configured to be operated from one side and from the other side of the flap 101.

Alternatively, the follower member 120 comprises two opposite facing guide profiles, so that it can be driven along the direction d101 and along the opposite direction by pressing the flap against one or other of the guide profiles.

Alternatively, a plurality of follower members 120 are provided on a single connecting rod 60.

Alternatively, the follower member is formed by a housing provided in the connecting rod 60.

Figure 13:
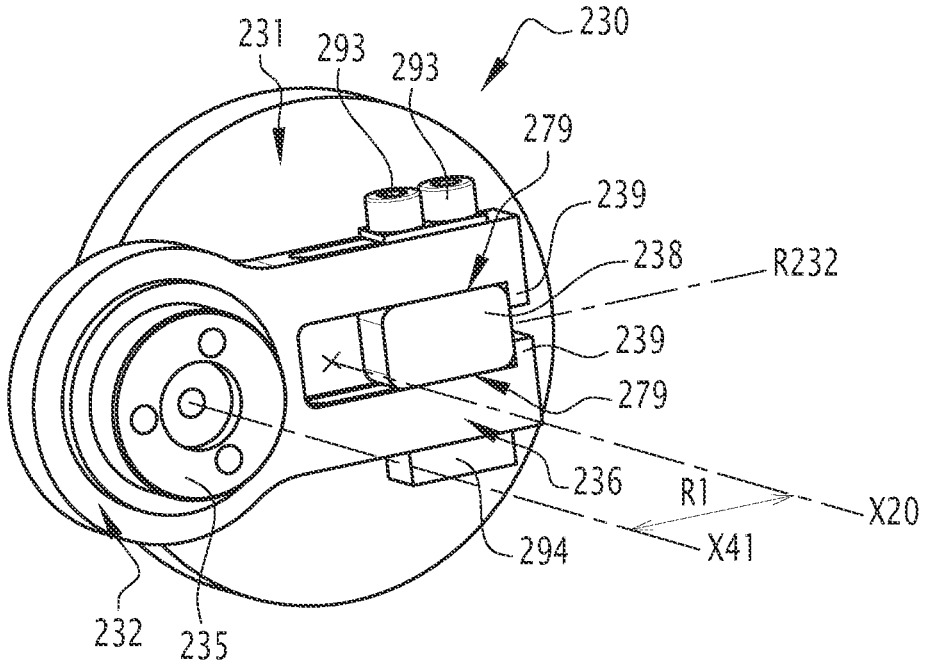
FIG. 13 is a perspective view of an eccentric system, belonging to a loom according to a second embodiment of the invention.
Figure 14:
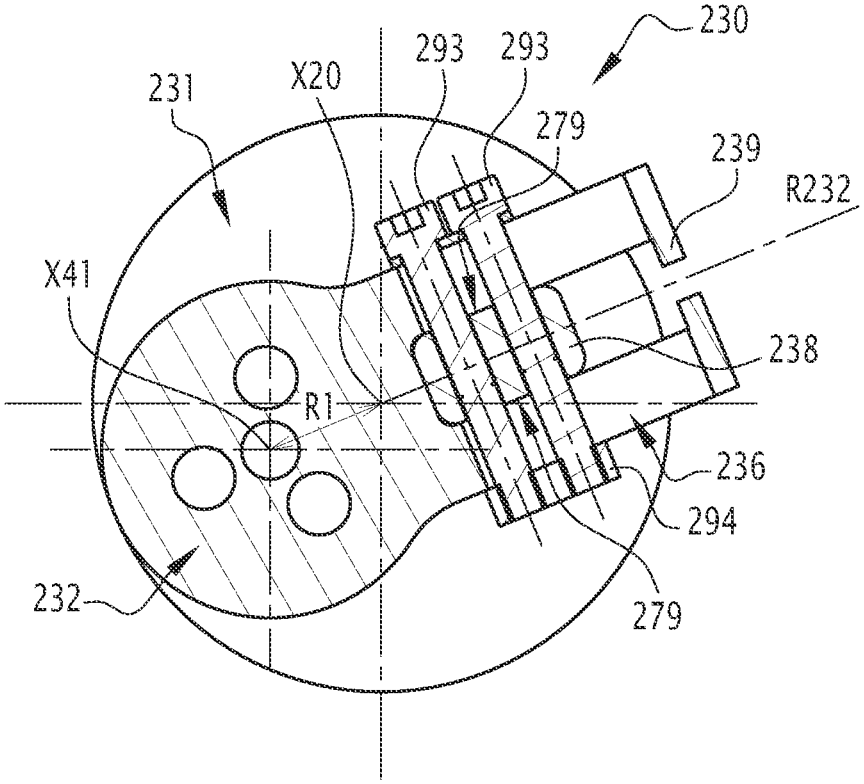
FIG. 14 is a cross-sectional view of the eccentric system of FIG. 13, with the eccentric system at a different setting.
Figure 15:
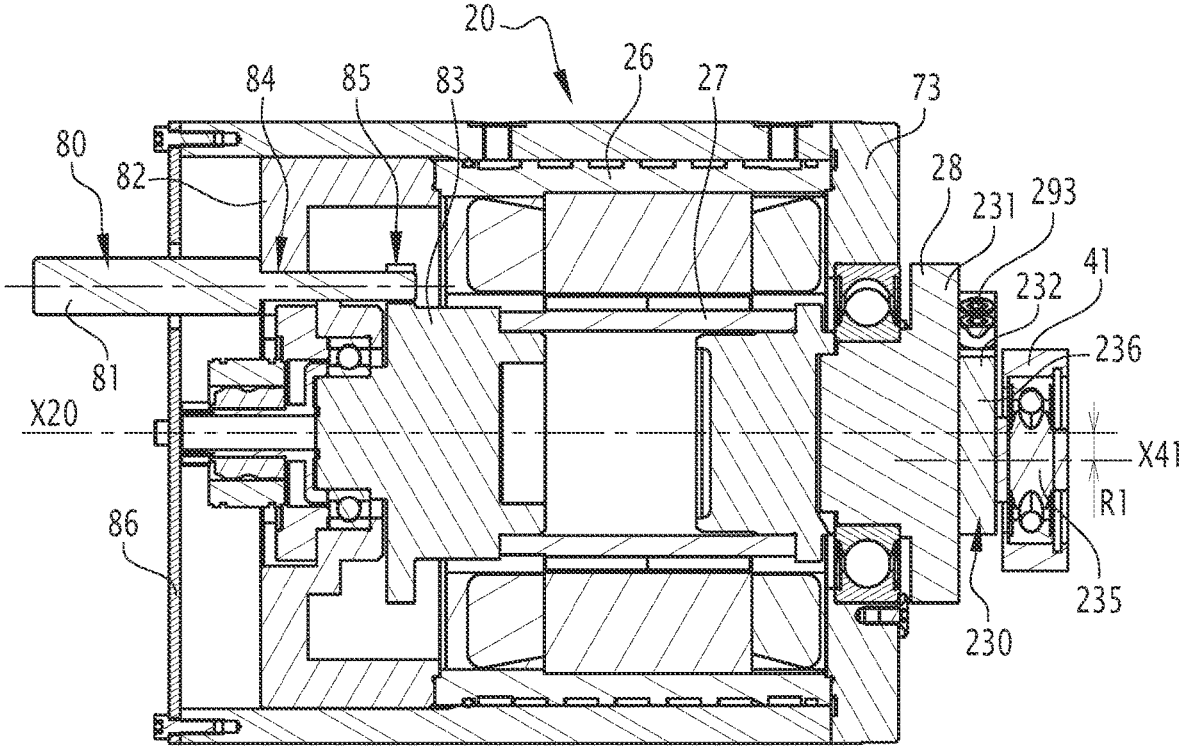
FIG. 15 is a cross-sectional view of one of the shedding machines belonging to the loom of FIGS. 13 and 14, showing in particular a locking system.

FIGS. 13 to 15 show an eccentric system 230 for a second embodiment, with a loom identical to the loom 1 of FIGS. 1 to 11, except specifically for this eccentric system 230, replacing the eccentric system 30. The eccentric system 230 is different in structure relative to the eccentric system 30, but nevertheless ensures the same functions. The elements of the eccentric system 230 which are similar to or have the same function as those of the eccentric system 30 are designated with the same reference sign increased by 200. Identical elements are designated with the same reference sign.

The eccentric system 230 comprises a base 231, which has the same function as the base 31, and a linkage 232, which has the same function as the linkage 32. The eccentric system 230 is driven in rotation by the actuator 20, about the axis X20, by means of the base 231. The linkage 232 defines the eccentric axis X41 and is coupled to the articulation end 41 of the connecting rod 40 in the same manner as the linkage 32. In the amplitude adjustment configuration, the linkage 232 is moved relative to the base 231 to change the value of the distance R1. In the locking configuration, the linkage 232 is fixed relative to the base 231. As shown in FIG. 15, the locking system 80 is unchanged relative to the embodiment of FIGS. 1 to 12 and operates in the same manner, locking the rotation of the base 231 in the locking configuration, and allowing the rotation of the base 231 in the release configuration.

Along the axis X20, the base 231 is preferably arranged between the actuator 20 and the linkage 232. As shown in FIG. 15, the base 231 is directly formed by, or attached to, the output shaft 28 of the actuator 20, so as to be directly rotated about the axis X20 by the actuator 20. The axis X20 is fixed relative to the base 31. The orientation of the output shaft 28 about the axis X20 corresponds to that of the base 231. By means of the base 231, the entire eccentric system 230 is driven in rotation by the actuator 20 about the axis X20.

As illustrated in FIGS. 13 and 14, so that the eccentric center distance R1 can be variable, the geometry of the eccentric system 230 is adjustable, and in particular the linkage 232 is made movable relative to the base 231. The adjustment system comprises a locking means for selectively allowing this movement, to obtain the amplitude adjustment configuration, and prohibiting this movement, to obtain the locked configuration or the height adjustment configuration. As with the eccentric system 30, it is provided that, in order for the eccentric center distance R1 to be adjustable when the adjustment system is in the amplitude adjustment configuration, the linkage 232 is moveable in translation relative to the base 231 along a translation axis R232 that is perpendicular to the main axis X20. As with the eccentric system 30, it is also provided that the linkage 232 is prevented from rotating relative to the base 231 about the axis X20.

The base 231 here forms a discoidal plate perpendicular to the axis X20, formed at one end of the output shaft 28. The base 231 also comprises a sliding lug 238. The lug 238 is formed projecting from the discoidal plate, parallel to the axis X20. The lug 238 forms two sliding surfaces 279, which face away from each other. In the longitudinal direction, these surfaces 279 are directed parallel to the axis R232. In the transverse direction, these surfaces 279 are directed parallel to the axis X20.

The linkage 232 comprises the crank pin 235, visible in FIGS. 13 and 15. In the example, the crank pin 35 is generally cylindrical in shape with a circular base, and is centered on the axis X41, to support the pivoting of the connecting rod 40 relative to the linkage 32.

In place of the flange 36, the linkage 232 comprises a fork 236. The fork 236 is attached with crank pin 235. Along the axis X20, the fork 236 is arranged between the crank pin 35 and the base plate 231. The fork 236 comprises two sliding arms, which are parallel to the axis R232. The lug 238 is received between the two arms of the fork 236. Thus, the arms of the fork 236 and the lug 238 are arranged in the same plane perpendicular to the axis X20. Each arm of the fork 236 slides along one of the surfaces 279. Thus, the assembly constituted by the fork 236 and the lug 238 forms a connection supporting the sliding of the linkage 232 along the axis R232 relative to the base 231, while preventing the rotation of the linkage 232 about the axis X20 relative to the base 231. The movement in translation of the part 232 takes place between a first position shown in FIG. 13, corresponding to a maximum distance value R1, and a second position shown in FIG. 14, corresponding to a minimum distance value R1. The movement of the linkage 232 is limited between these two extreme positions, in that, as shown in FIG. 14, the lug 238 comes into abutment against a base of the fork 236, for the minimum distance value R1, and in that, as shown in FIG. 13, the lug 238 comes into abutment in the opposite direction against the notches 239 carried at the end of the arms of the fork 236, for the maximum distance value R1. The fork 236 therefore forms the amplitude adjustment stops.

In order to obtain that the linkage 232 is moveable to perform the adjustment, while being able to be selectively fixed in radial translation relative to the base 231 in the locked configuration, it is preferentially provided that the locking means of the eccentric system 230 comprises one or more clamping screws 293. The screws 293 have an orientation perpendicular to the axis X20 and are parallel to each other. In the locked configuration and in the height adjustment configuration, the screws 293 are in a locking position, where the screws 293 clamp the sliding arms of the fork 236 to the lug 238. Then, the linkage 232 is integral with the base 231. In the amplitude adjustment configuration, the screws 293 are in a position to loosen the sliding arms on the lug 238, to allow the movement in translation of the linkage relative to the base.

For example, as clearly visible in FIG. 14, each screw 293 successively passes through a first sliding arm of the fork 236, the lug 238, then a second arm of the fork 236, and then a shoe 294. Each screw 293 is screwed into the shoe 294. In order for the screws to pass through the fork arms 236 without impeding the movement of the linkage 232 in the amplitude adjustment configuration, each arm has an oblong opening, visible in FIGS. 13 and 14, through which the screw 293 passes, the oblong opening being elongated parallel to the axis R232. The screw head is arranged against the first sliding arm of the fork 236, that is, opposite the shoe 294. As the screw 293 is tightened, the head of the screw 293 presses against the first arm of the fork 236, while the shoe 294 presses in the opposite direction against the second arm. The lug 238 is then clamped between the two arms of the fork 236.

For this embodiment, the locking and amplitude adjustment configuration is performed from the front end of the actuator 20, that is, the eccentric system side. As shown in FIG. 15, there is advantageously no need to provide a screw or rod that passes through the actuator 20, so this eccentric system 230 is easily adaptable to a pre-existing actuator.

Figure 16:
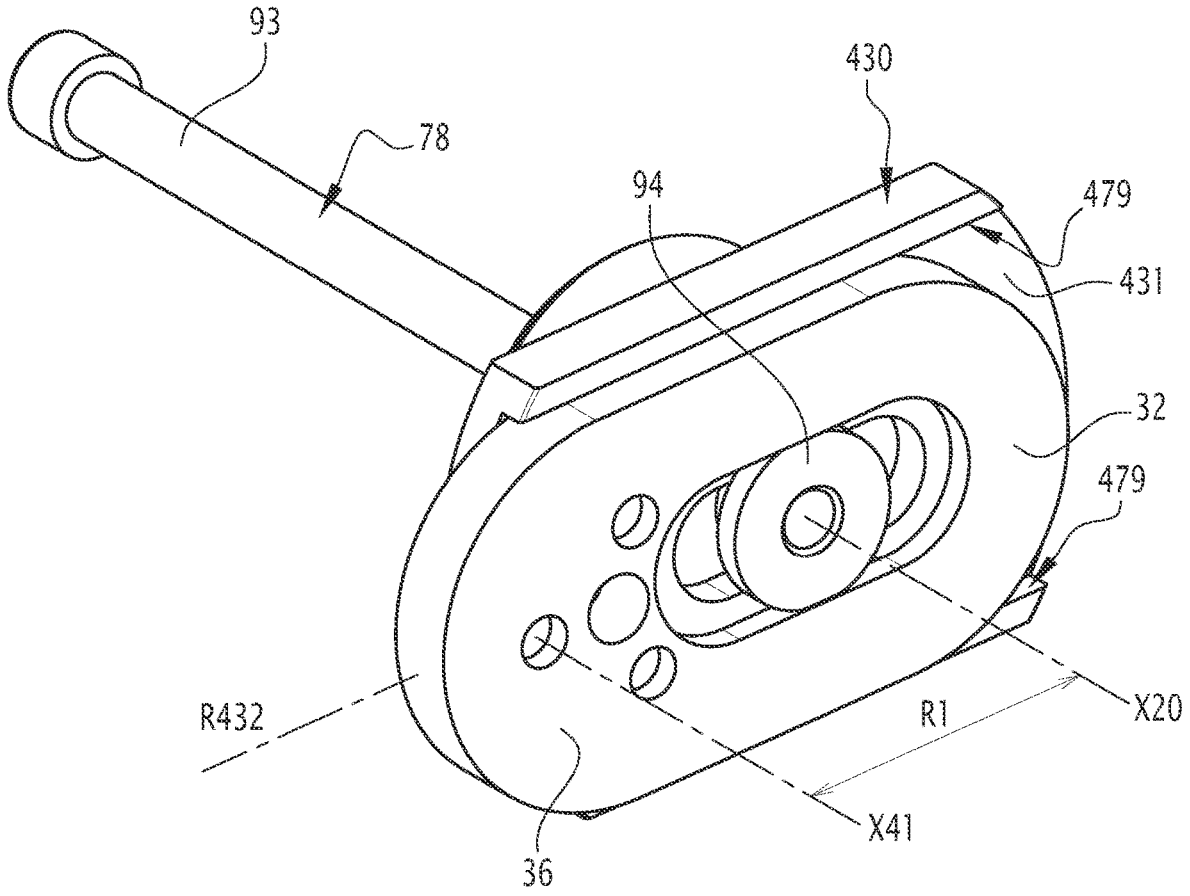
FIG. 16 is a perspective view of an eccentric system, belonging to a loom according to a third embodiment of the invention.

FIG. 16 shows an eccentric system 430 for a third embodiment, with a loom identical to the loom 1 of FIGS. 1 to 11, except specifically for this eccentric system 430, replacing the eccentric system 30. The eccentric system 430 is different in structure from the eccentric system 30, but nevertheless ensures the same functions. The elements of the eccentric system 430 that are similar or have the same function as those of the eccentric system 30 are designated with the same reference sign increased by 400. The identical elements are designated with the same reference sign.

The eccentric system 430 comprises a base 431, which has the same function as the base 31. The eccentric system 430 also comprises the linkage 32, which is identical to the system 30 and performs the same function. The eccentric system 430 is driven in rotation by the actuator 20, about the axis X20, by means of the base 431. The linkage 32 defines the eccentric axis X41 and is coupled to the articulation end 41 of the connecting rod 40, as seen previously. In the amplitude adjustment configuration, the linkage 32 is moved relative to base 431 to change the value of the distance R1. In the locking configuration, the linkage 32 is fixed relative to the base 431. The locking system 80 is unchanged relative to the embodiment of FIGS. 1 to 12 and operates in the same manner, locking the rotation of the base 431 in the locking configuration, and allowing the rotation of the base 431 in the release configuration.

In order to achieve a variable distance R1 when the adjustment system is in the amplitude adjustment configuration, the linkage 32 is supported by the base 431 by being moved in translation in a radial manner relative to the base 431 along a translation axis R432. The linkage 32 is also prevented from pivoting relative to the base 431, about the axis X20. The axis R432 is radial relative to the axis X20 and lies parallel to the distance R1. For any position of the linkage 32 relative to the base 431, the axis R432 intersects the axis X20 and the axis X41. By moving in translation, the linkage 32 relative to the base 431 along the axis R432, the distance R1 is varied.

In order to obtain that the linkage 32 can be fixed relative to the base 431, it is preferably provided that the oblong opening 77 of the flange 36, parallel to the axis R432, is traversed by a rod 78 of the eccentric system 430, identical to the rod 78 of the eccentric system 30.

In the present embodiment, the base 431 forms a plate perpendicular to the axis X20, against which the flange 36 is arranged, and further comprises two lateral rails, which project from the plate, and between which the flange 36 slides. To be precise, each rail forms a respective sliding surface 479, parallel to the axis R432. The sliding surfaces 479 are facing each other. The outer edges of the flange 36 each move along one of the surfaces. The surfaces 479 thus guide the sliding of the linkage 32 relative to the base 431 along the axis R432, while preventing the rotation of the linkage 32 relative to the base 431 about the axis X20. Thanks to these provisions, it is advantageously not mandatory for the nut 94 to ensure this guidance in translation, contrary to what is provided for the eccentric system 30 described above.

Any feature described above for one of the embodiments or variants may be implemented for the other embodiments and variants, insofar as technically possible.

The invention claimed is:

1. A shedding assembly comprising at least one shedding machine, for operating a heald frame of a loom according to a reciprocating translational stroke along a frame axis, said at least one shedding machine comprising:

a rotary electric actuator;

an actuator controller able to control the rotary electric actuator;

an eccentric system, which comprises:

a base by means of which the eccentric system is rotated by the rotary electric actuator about a main axis perpendicular to the frame axis, and a linkage defining an eccentric axis, the eccentric axis being parallel to the main axis;

a first lever, which is pivotable about a first lever axis to actuate said heald frame, the first lever axis and the main axis being parallel;

a second lever, which is pivotable about a second lever axis to actuate said heald frame, the second lever axis and the main axis being parallel;

a first connecting rod, which comprises:

a first articulation end, by means of which the first connecting rod is coupled to the linkage, so that the eccentric system and the first connecting rod are pivotable relative to each other about the eccentric axis, the eccentric axis and the main axis being distant by an eccentric center distance, and a second articulation end, by means of which the first connecting rod is coupled to the first lever, so that the first lever and the first connecting rod are pivotable relative to each other about a connecting rod axis, which is parallel to the main axis, the connecting rod axis and the eccentric axis being distant by a connecting rod center distance; and a second connecting rod, which is coupled to the first lever and the second lever, making the second lever pivot in conjunction with the pivoting of the first lever;

an adjustment system, which comprises locking means and which allows:

at least one adjustment configuration, among:

an amplitude adjustment configuration, wherein the locking means allow a movement of the linkage relative to the base so that the eccentric center distance is adjustable, and a height adjustment configuration, wherein the locking means allows movement of the second articulation end relative to the first articulation end so that the connecting rod center distance is adjustable; and a locked configuration, wherein the eccentric center distance and the connecting rod center distance are fixed, wherein that the locking means is configured so that the linkage is integral with the base and the first articulation end is integral with the second articulation end; and a follower member, which equips the second connecting rod;

and wherein the shedding assembly comprises a flap, which is configured to move the second connecting rod of said at least one shedding machine by driving the follower member, in order to adjust the eccentric center distance, in the case where the adjustment system is in an amplitude adjustment configuration, and to adjust the connecting rod center distance, in the case where the adjustment system is in a height adjustment configuration.

2. The shedding assembly according to claim 1, wherein a plurality of shedding machines are provided, each for operating a respective heald frame, the flap being configured to move the second connecting rods belonging to the respective shedding machines by driving the follower members provided on said second connecting rods.

3. The shedding assembly according to claim 2, wherein:

the second connecting rods of the shedding machines are mounted side by side parallel to the main axis; and the flap extends parallel to the first lever axis from one of the second connecting rods to another of the second connecting rods to drive at least one of the follower members equipping respectively one or other of the second connecting rods in an adjustment configuration of the adjustment system.

4. The shedding assembly according to claim 1, wherein, the flap pivots about a control axis parallel to the main axis, in order to move the second connecting rod by driving the follower member of the said at least one shedding machine.

5. The shedding assembly according to claim 4, wherein the shedding assembly comprises:

a flap actuator, which is configured to actuate the flap by pivoting about the control axis; and a flap controller, configured to control the flap actuator.

6. The shedding assembly according to claim 4, wherein the follower member of said at least one shedding machine comprises:

a guide profile, which is convex in a connecting rod plane, perpendicular to the first lever axis, the flap pressing against the guide profile, at different pressure points of the guide profile depending on the orientation of the flap, to drive the follower member; and a foot, by means of which the follower member is integral with the second connecting rod, the foot defining a clearance profile for receiving a distal edge of the flap when the flap presses against the guide profile, the clearance profile being concave in the plane of the connecting rod and extending between the guide profile and the second connecting rod.

7. The shedding assembly according to claim 1, wherein the flap is movable between:

a working position, adopted in the adjustment configuration, where the flap presses against the follower member along a retaining direction, to retain the second connecting rod by means of the follower member, against forces applied by the heald frame due to gravity on the first lever and on the second lever, tending to move the second connecting rod in the opposite direction to the retaining direction; and a release position, adopted in the locked configuration, which is attained by moving the flap in the opposite direction to the retaining direction from the working position.

8. The shedding assembly according to claim 1, wherein, in order for the eccentric center distance to be adjustable when the adjustment system is in the amplitude adjustment configuration, the linkage is movable in translation relative to the base, along a translation axis which is perpendicular to the main axis.

9. The shedding assembly according to claim 8, wherein the base comprises at least one sliding surface parallel to the translation axis, by means of which the base guides the translation of the linkage along the translation axis while securing the rotation of the linkage, when the adjustment system is in the amplitude adjustment configuration.

10. The shedding assembly according to claim 9, wherein:

the base includes a sliding lug forming two sliding surfaces, which are directed away from each other;

the linkage comprises a fork forming two sliding arms, which are parallel to the translation axis, and which receive the sliding lug between them, so that each sliding arm slides along one of the two sliding surfaces respectively; and the locking means comprises a clamping screw, which:

in the locked configuration of the adjustment system, is in a position of clamping the sliding arms of the fork to the sliding lug, to secure the linkage to the base, and in the amplitude adjustment configuration of the adjustment system, is in a position of loosening the sliding arms on the lug, to allow the movement in translation of the linkage relative to the base.

11. The shedding assembly according to claim 8, wherein:

the locking means comprises a clamping screw and a clamping nut, which are coaxial with the main axis;

the linkage comprises a flange, which extends perpendicular to the main axis, and which comprises an oblong opening, the oblong opening being elongated along the translation axis and receiving the nut; and the flange is axially clamped against the base by tightening the clamping nut on the clamping screw, to secure the linkage to the base when the adjustment system is in the locked configuration.

12. The shedding assembly according to claim 1, wherein said at least one shedding machine comprises a locking system, which allows for a locking configuration, where the locking system immobilizes the base in a reference orientation about the main axis, and a release configuration, where the locking system allows for pivoting of the base about the main axis.

13. The shedding assembly according to claim 1, wherein the first connecting rod comprises a first connecting rod end, carrying the first articulation end, and a second connecting rod end, carrying the second articulation end, the first connecting rod end and the second connecting rod end are slidable relative to each other along a sliding axis, so that the connecting rod center distance is adjustable.

14. A loom, comprising the shedding assembly according to claim 1, as well as at least one heald frame actuated according to the reciprocating translational stroke along the frame axis by said at least one shedding machine.

15. An adjustment method, for adjusting said at least one shedding machine belonging to the shedding assembly according to claim 1, the adjustment method comprising:

a step of putting the adjustment system in adjustment configuration;

in the case where the adjustment system is in the amplitude adjustment configuration, a step of adjusting the eccentric center distance, by driving the follower member by means of the flap, moving the second connecting rod and, in the case where the adjustment system is in a height adjustment configuration, a step of adjusting the connecting rod center distance by driving the follower member by means of the flap, moving the second connecting rod and a step of putting the adjustment system in a locked configuration.

16. The adjustment method according to claim 15, wherein the flap is movable between:

a working position, adopted in the adjustment configuration, where the flap presses against the follower member along a retaining direction, to retain the second connecting rod by means of the follower member, against forces applied by the heald frame due to gravity on the first lever and on the second lever, tending to move the second connecting rod in the opposite direction to the retaining direction; and a release position, adopted in the locked configuration, which is attained by moving the flap in the opposite direction to the retaining direction from the working position, and wherein the adjustment method comprises, prior to the step of putting the adjustment system in the adjustment configuration, a step of moving the flap to the working position.

17. The adjustment method according to claim 16, wherein said at least one shedding machine comprises a locking system, which allows for a locking configuration, where the locking system immobilizes the base in a reference orientation about the main axis, and a release configuration, where the locking system allows for pivoting of the base about the main axis, and wherein the adjustment method comprises:

before the step of moving the flap to the working position, a step of pivoting the base to the reference orientation, then a step of locking the base in the reference orientation, by putting the locking system into the locking configuration; and after the step of placing the adjustment system into the locked configuration, a step of allowing the pivoting of the base, by putting the locking system into the release configuration.

18. The adjustment method according to claim 17, wherein, when the base is in the reference orientation, the eccentric system and the first connecting rod are positioned so that the main axis, the eccentric axis and the connecting rod axis are coplanar and arranged successively in this order.

19. The adjustment method according to claim 17, wherein, when the base is in the reference orientation, the eccentric system and the first connecting rod are positioned so that the eccentric axis, the main axis and the connecting rod axis are coplanar and arranged successively in this order.

20. The adjustment method according to claim 17, wherein a plurality of shedding machines are provided, each for operating a respective heald frame, the flap being configured to move the second connecting rods belonging to the respective shedding machines by driving the follower members provided on said second connecting rods, and wherein the method comprises a selection step in which:

the follower member of the shedding machine for which the setting configuration step is to be performed, is moved to a docking position in which the flap is able to drive the follower member, the movement of the follower member to the docking position being obtained by movement of the second connecting rod under the action of the rotary electric actuator of this shedding machine; and the follower member of another shedding machine, for which the adjustment system will be in a locked configuration during the step of setting the adjustment configuration, is moved to a released position so as not to be driven by the flap, the movement of the follower member to the released position being obtained by movement of the second connecting rod under the action of the rotary electric actuator of the said other shedding machine.

21. The adjustment method according to claim 18, wherein a plurality of shedding machines are provided, each for operating a respective heald frame, the flap being configured to move the second connecting rods belonging to the respective shedding machines by driving the follower members provided on said second connecting rods, wherein the method comprises a selection step in which:

the follower member of the shedding machine for which the setting configuration step is to be performed, is moved to a docking position in which the flap is able to drive the follower member, the movement of the follower member to the docking position being obtained by movement of the second connecting rod under the action of the rotary electric actuator of this shedding machine; and the follower member of another shedding machine, for which the adjustment system will be in a locked configuration during the step of setting the adjustment configuration, is moved to a released position so as not to be driven by the flap, the movement of the follower member to the released position being obtained by movement of the second connecting rod under the action of the rotary electric actuator of the said other shedding machine, and wherein:

the second connecting rod of said shedding machine, for which the step of setting the adjustment configuration is going to be performed, is actuated by the rotary electric actuator of said shedding machine until the main axis, the eccentric axis and the connecting rod axis of said shedding machine are co-planar; and the second connecting rod of said other shedding machine is actuated by the rotary electric actuator of said other shedding machine until the main axis, the eccentric axis and the connecting rod axis of said other shedding machine are coplanar and arranged in a successive order in which the eccentric axis and the connecting rod axis are inverted, relative to the eccentric axis and the connecting rod axis of said shedding machine for which the step of setting the adjustment configuration is to be performed.

* * * * *